US005929405A

United States Patent [19]

Wehrli, III et al.

[11] Patent Number: 5,929,405

[45] Date of Patent: Jul. 27, 1999

[54] INTERLOCK FOR ELECTRICAL SWITCHING APPARATUS WITH STORED ENERGY CLOSING

[75] Inventors: Henry Anthony Wehrli, III, Monroeville; Raymond Clyde Doran, Jeannette; Phillip Lloyd Ulerich, Pittsburgh, all of Pa.

[73] Assignee: Eaton Corporation, Cleveland, Ohio

[21] Appl. No.: 09/074,104

[22] Filed: May 7, 1998

[51] Int. Cl.[6] ..... H01H 31/00

[52] U.S. Cl. ..... 200/50.01; 200/400; 200/401; 335/74; 335/76

[58] Field of Search ..... 200/400, 319, 200/401, 50.02, 50.15; 335/74–77, 140

[56] References Cited

U.S. PATENT DOCUMENTS

| | | | |
|---|---|---|---|
| 5,192,934 | 3/1993 | Millianowicz et al. . | |
| 5,200,585 | 4/1993 | Davies et al. . | |
| 5,224,590 | 7/1993 | Millianowicz et al. . | |
| 5,478,979 | 12/1995 | Castonguay et al. . | |
| 5,713,459 | 2/1998 | Beck et al. | 200/401 |

*Primary Examiner*—Michael L. Gellner
*Assistant Examiner*—Nhung Nguyen
*Attorney, Agent, or Firm*—Martin J. Moran

[57] ABSTRACT

Electrical switching apparatus such as a power circuit breaker, network protector or switch has a self-supporting operating mechanism module including a cage formed by a pair of side plates rigidly clamped in spaced relation by spacers. The cage supports all of the operating mechanism components including a helical compression close spring mounted fully between the side plates and coupled to a cam member through a rocker in a manner which maintains the forces longitudinal to the spring. The cam member has a charging cam with a charge profile for compressing the close spring and a close profile through which the spring drives the cam member to effect a controlled release of stored energy to close the contacts of the apparatus. A close prop, spring biased to an unlatched position, is latched to secure the close spring in the charged state by a latch assembly reset by a reset lever separate from the close prop which in turn is reset by rotation of the cam member during charging. An interlock prevents release of the close spring when the contacts are closed or the trip release is actuated. An indicator actuated by a driver pivoted against the cam shaft snaps from a DISCHARGED to a CHARGED indication as the close spring becomes fully charged and the driver drops into a notch created by a flat on the cam shaft. Rotating shafts are journalled solely in confronting apertures in the side plates. The cam shaft is captured between bushings seated in non-circular openings in the side plates thereby eliminating the need for any fasteners. Likewise, other parts mounted between the side plates and joined by pins having enlarged heads retained by the side plates do not need retainers. Various shafts extending between the side plates have reduced diameter ends of progressive lengths for successive insertion in one side plate to aid in assembly of the operating mechanism.

20 Claims, 30 Drawing Sheets

FIG. 7
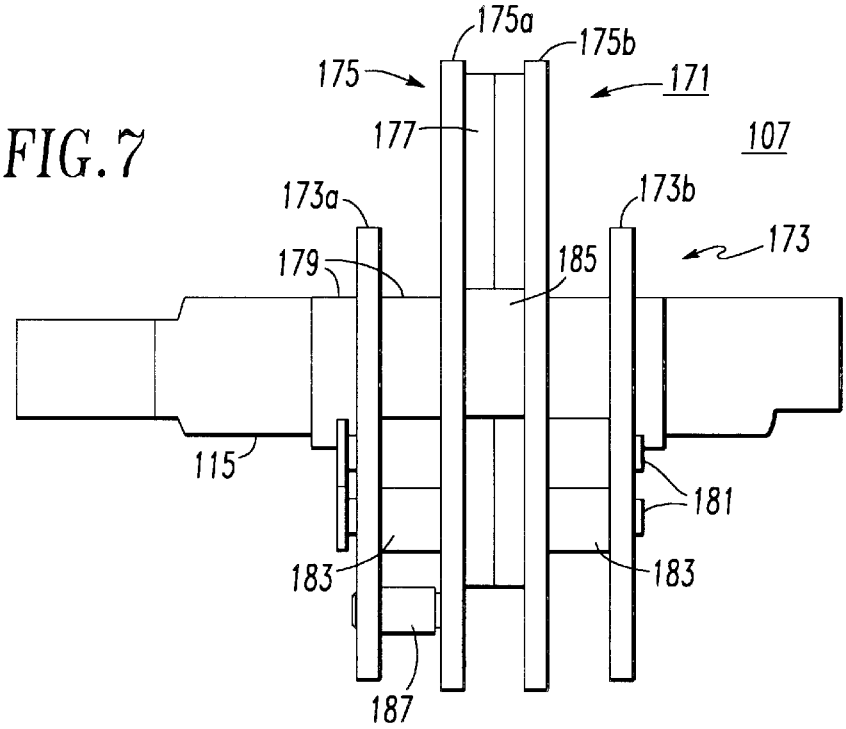
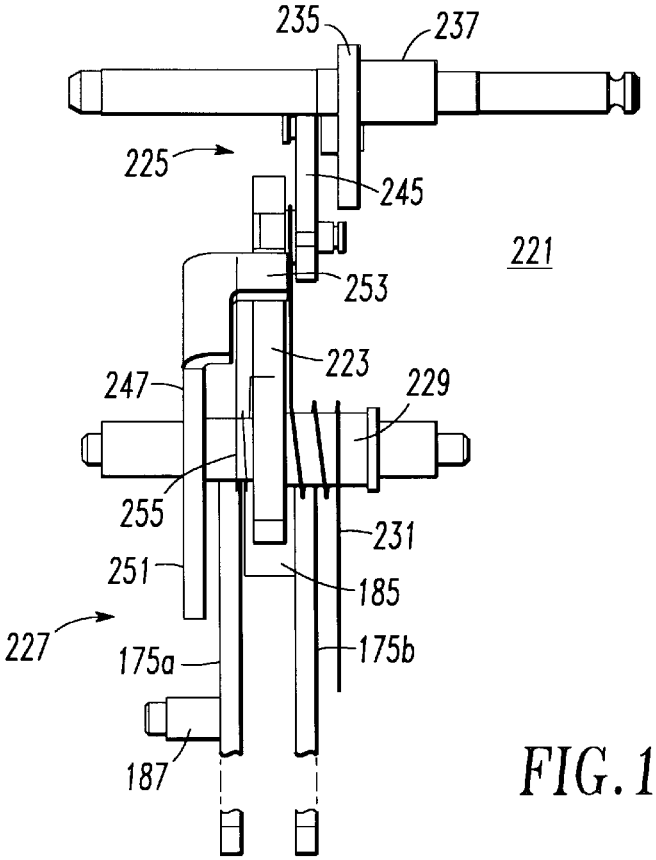
FIG. 16

FIG. 18
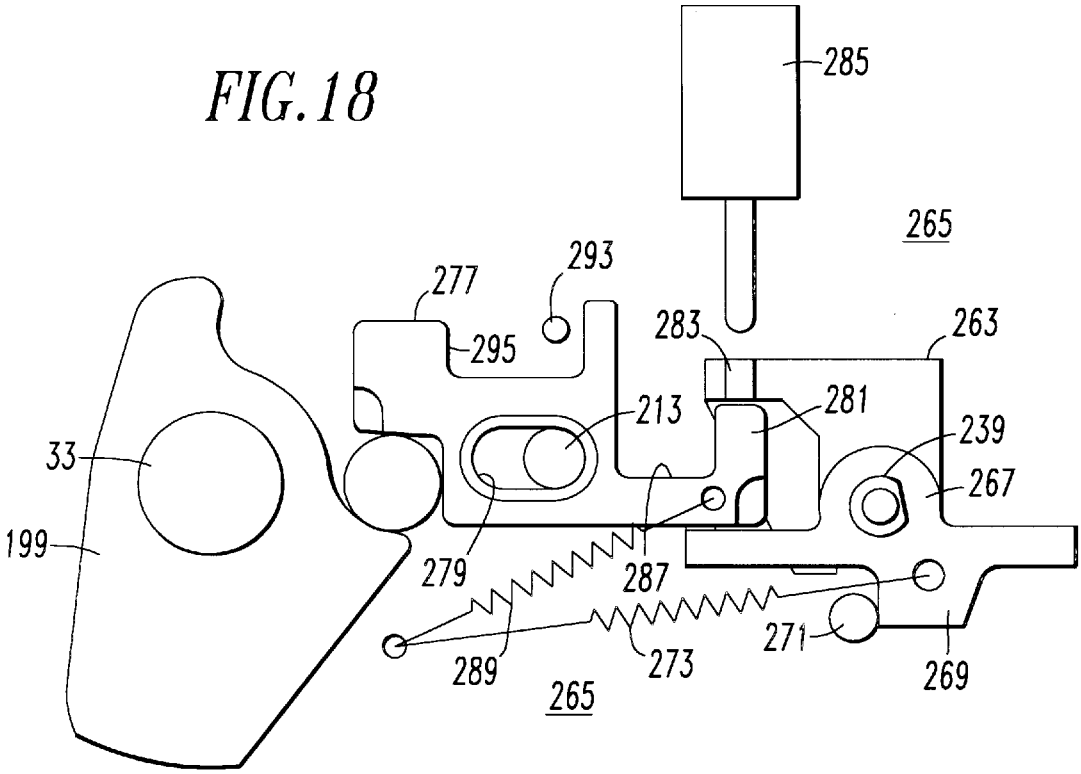
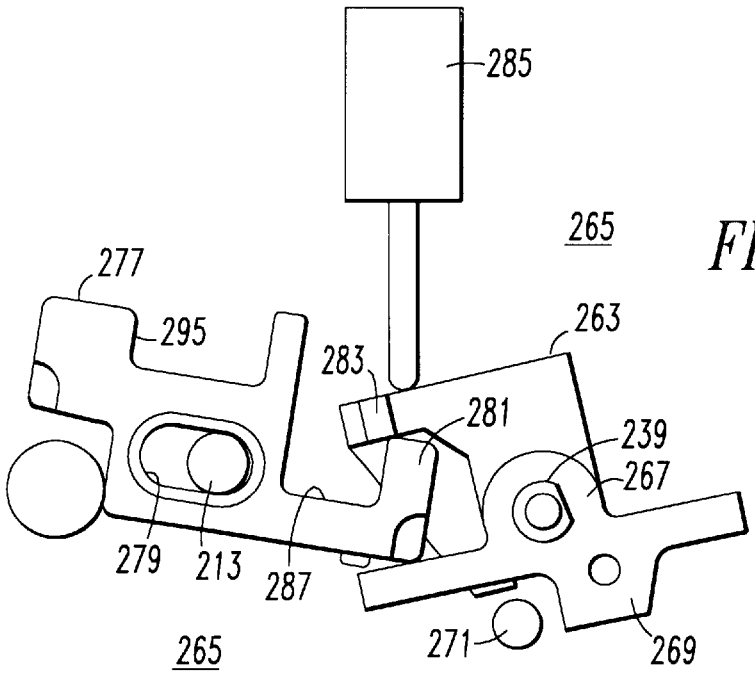
FIG. 19

FIG.20
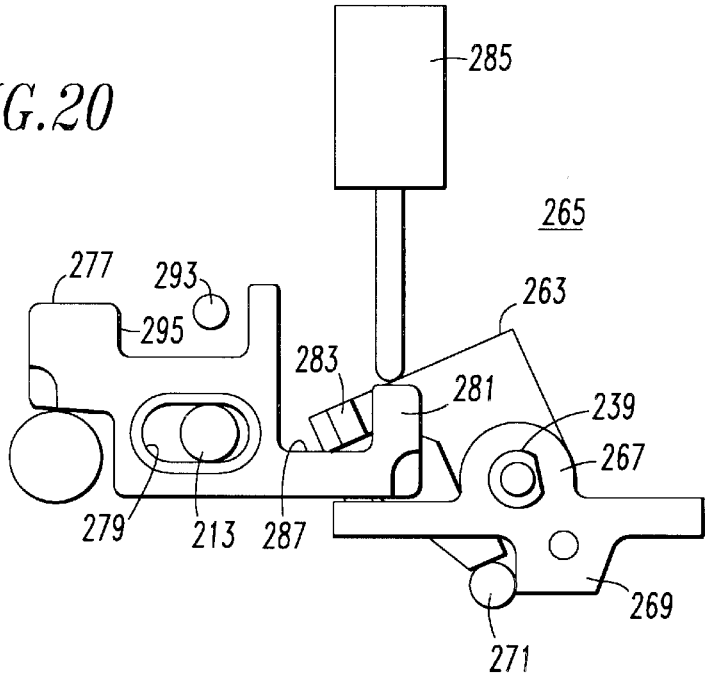
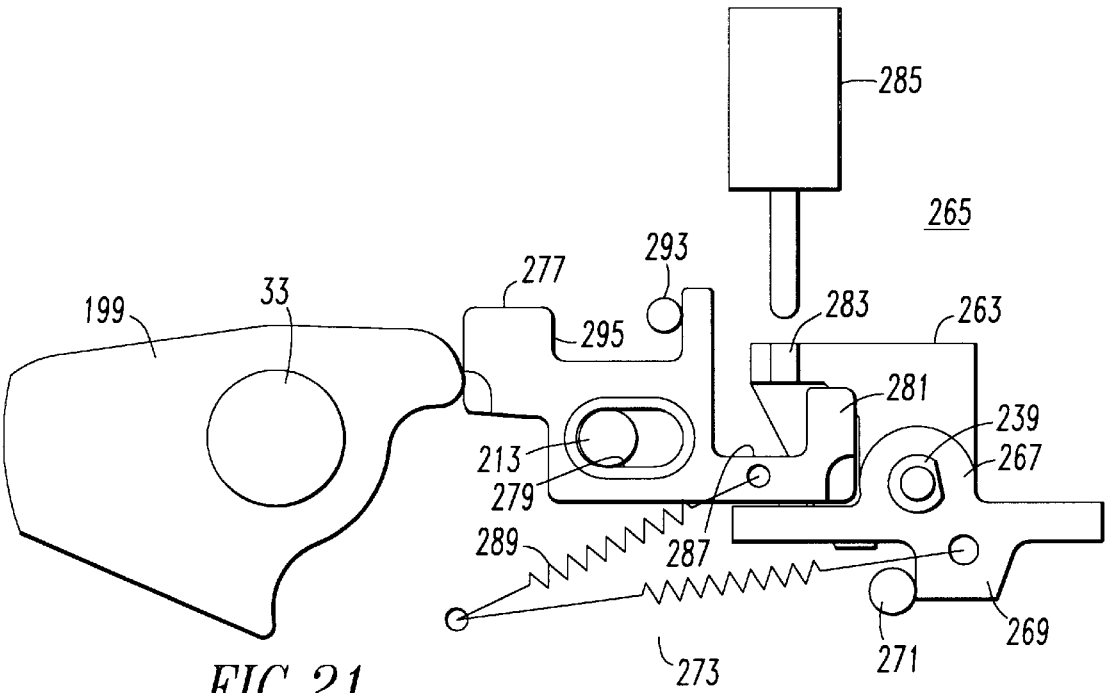
FIG.21

FIG.25
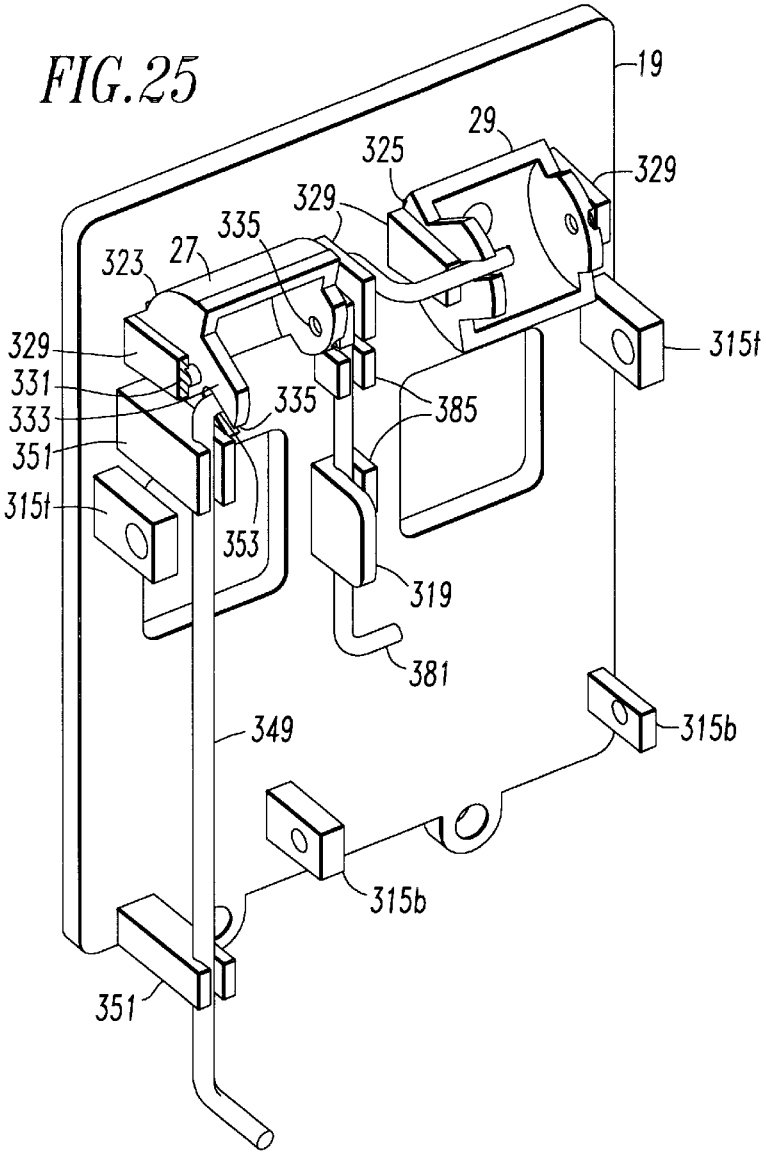
FIG.26
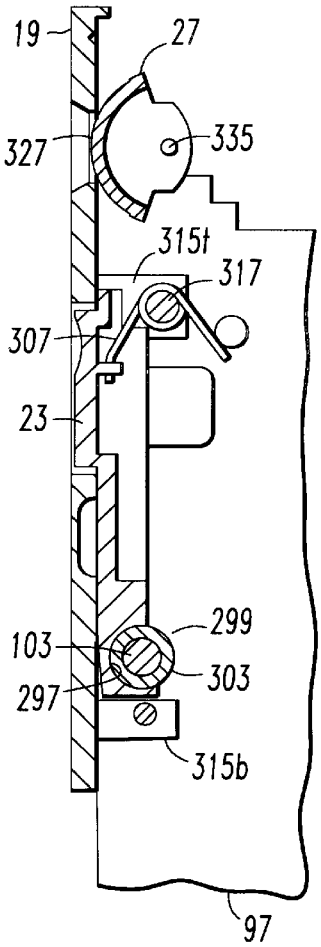
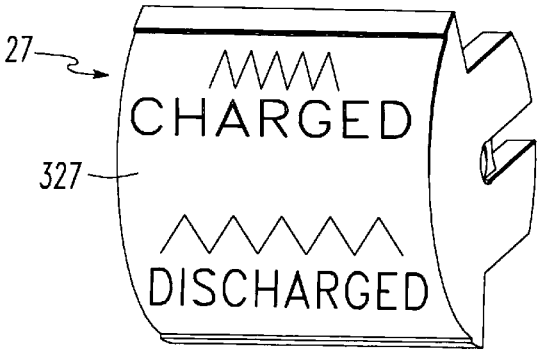
FIG.27

INTERLOCK FOR ELECTRICAL SWITCHING APPARATUS WITH STORED ENERGY CLOSING

CROSS REFERENCES TO RELATED APPLICATIONS

This application is related to commonly owned, concurrently filed patent applications:

Ser. No. 09/074,135, "ELECTRICAL SWITCHING APPARATUS WITH CONTACT FINGER GUIDE";

Ser. No. 09/074,046, "ELECTRICAL SWITCHING APPARATUS WITH OPERATING CONDITION INDICATORS MOUNTED IN FACE PLATE";

Ser. No. 09/074,075, "ELECTRICAL SWITCHING APPARATUS WITH IMPROVED CONTACT ARM CARRIER ARRANGEMENT";

Ser. No. 09/047,073, "CHARGING MECHANISM FOR SPRING POWERED ELECTRICAL SWITCHING APPARATUS";

Ser. No. 09/074,240, "ELECTRICAL SWITCHING APPARATUS WITH MODULAR OPERATING MECHANISM FOR MOUNTING AND CONTROLLING LARGE COMPRESSION CLOSE SPRING";

Ser. No. 09/074,233, "ELECTRICAL SWITCHING APPARATUS WITH PUSH BUTTONS FOR A MODULAR OPERATING MECHANISM ACCESSIBLE THROUGH A COVER PLATE";

Ser. No. 09/074,133, "CLOSE PROP AND LATCH ASSEMBLY FOR STORED ENERGY OPERATING MECHANISM OF ELECTRICAL SWITCHING APPARATUS";

Ser. No. 09/074,075, "SNAP ACTING CHARGE/DISCHARGE AND OPEN/CLOSED INDICATORS DISPLAYING STATES OF ELECTRICAL SWITCHING APPARATUS";

Ser. No. 09/074,234, "ELECTRICAL SWITCHING APPARATUS HAVING ARC RUNNER INTEGRAL WITH STATIONARY ARCING CONTACT"; and Ser. No. 09/074,052, "DISENGAGEABLE CHARGING MECHANISM FOR SPRING POWERED ELECTRICAL SWITCHING APPARATUS".

The Government has rights in this invention under Government Contract Number N61331-94-C-0078.

BACKGROUND OF THE INVENTION

1. Field of the Invention

This invention relates to electrical switching apparatus such as power circuit breakers, network protectors and switches used in electric power circuits carrying large currents. More particularly, it relates to such apparatus which utilizes a large spring to store sufficient energy to close the contacts of the apparatus against the sizeable magnetic repulsion forces generated by the large currents. Specifically, it relates to an interlock which prevents release of the close spring when the contacts are already closed, or simultaneously with actuation of a trip device which opens the separable contacts.

2. Background Information

Electrical switching apparatus for opening and closing electric power circuits typically utilize an energy storage device in the form of one or more large springs to close the contacts of the device into the large currents which can be drawn in such circuits. Such electrical apparatus includes power circuit breakers and network protectors which provide protection, and electrical switches which are used to energize and deenergize parts of the circuit or to transfer between alternative power sources. The close spring is charged either by a manual charging handle or an electric motor. The energy stored in the close spring is released to rapidly close the contacts by a push to close button on the circuit breaker switch or by a solenoid which may be remotely actuated.

Such power protection devices and switches also include an open spring or springs which rapidly separates the contacts to interrupt current flowing in the power circuit. As indicated, either or both of the close spring and open spring can be a single spring or multiple springs and should be considered as either even though the singular is hereafter used for convenience. The open spring is charged during closing by the close spring which therefore must store sufficient energy to both overcome the mechanical and magnetic forces for closing as well as charging the open spring. The stored energy in the open spring is released, again, either by an open push button on the apparatus, or by a solenoid which may be remotely energized.

Once the contacts have been closed, the close spring may be recharged to be ready for a subsequent closing. Since the contacts are already closed, it is known to provide an interlock which prevents discharge of the close spring while the contacts are closed. It is also known to provide an interlock which prevents simultaneous actuation of both the open push button and the close button. In other circuit breakers of this type, it is known to have an interlock which gives priority to the open button or solenoid so the circuit breaker can always be opened. While these interlocks have been effective, there is room for improvement.

There is a need in general for an improved interlock for electrical switching apparatus.

In particular, there is a need for an interlock which gives priority to opening the contacts of the electrical switching apparatus.

There is a further need for such an interlock which prevents release of the closing springs when the contacts are closed.

SUMMARY OF THE INVENTION

These needs and others are satisfied by an interlock for electrical switching apparatus for opening and closing an electric power circuit, such as a power circuit breaker, network protector or a power switch, which includes an interlock member between a close spring release lever which releases the close spring, and a close spring release platform which initiates release of the close spring. The interlock member has a first position in which movement of the close spring release platform is transmitted to the close spring release lever to release the close spring, and a second position in which movement of the close spring release platform is not transmitted to movement of the close spring release lever and therefore release of the close spring means is not effected. Biasing means biases the interlock member to the first position which couples the close spring release platform to the close spring release lever.

Preferably, a closed contact member engages the interlock member to move it to the second position when the contacts of the electrical switching apparatus are already closed. Also preferably, the trip member which releases the open spring means to open the electrical switching apparatus has means which move the interlock member to the second position in which the release platform is decoupled from the close spring release lever whenever the trip member is actuated. In the exemplary form of the invention, the close spring release platform has a finger which engages the interlock member when the close spring release platform is rotated with the interlock member in the first position. The interlock member has a recess into which the finger on the close spring release platform rotates without rotating the interlock member with the interlock member in the second position. In addition, the finger is sized to slide off the interlock member into the recess with continued rotation of the close spring release platform after engaging the interlock member to initiate closing of the contacts with the interlock member in the first position to provide an anti-pumping feature which prevents separate firing of the close spring. Preferably, the close spring release lever is secured to a close latch pin which is rotated by rotation of the release lever to release the charge spring means and the close spring release platform is pivoted on but rotates independently of the close latch pin.

The invention also relates to electrical switching apparatus, such as a circuit breaker, network protector or a power switch, which is opened and closed to control power flow in an electric power circuit and which includes an interlock assembly as described above. In the exemplary embodiment of the electrical switching apparatus, the trip member comprises a latch pin rotatable to an unlatched position to release the open spring means and a lever mounted on the latch pin which engages and slides the interlock member to the second position as the latch pin rotates to the unlatch position. The operating mechanism of the electrical switching apparatus includes a push to close button rotating the close spring release platform when the push to close button is actuated and a push to open button rotating the trip lever to rotate the latch pin to the unlatch position and to move the interlock member to the second position when the open push button is actuated. In the preferred form of the invention, the operating mechanism includes a cage formed by a pair of side plates fixed in rigid spaced relation and the mounting means for the close spring release lever, close spring release platform and the trip means are all fully supported by the cage.

BRIEF DESCRIPTION OF THE DRAWINGS

A full understanding of the invention can be gained from the following description of the preferred embodiments when read in conjunction with the accompanying drawings in which:

FIG. 7 is a side elevation view of the cam assembly which forms part of the operating mechanism.

FIG. 16 is an end view of the close prop assembly.

FIG. 18 is a side elevation view of the interlock of FIG. 17 shown with the contacts in the open state.

FIG. 19 is a view similar to FIG. 18 showing operation of the interlock when the close solenoid is actuated.

FIG. 20 is a view similar to that of FIG. 18 in the "fire through" condition which prevents the close spring from being repeatedly fired by continuous actuation of the close solenoid.

FIG. 21 is a view similar to that of FIG. 18 showing the condition of the latch assembly when the circuit breaker main contacts are closed.

FIG. 25 is an isometric view of the rear of the face plate showing the mounting of the indicator flags.

FIG. 26 is a vertical section through the face plate taken along the line 26 in FIG. 24.

FIG. 27 is an isometric view of the close spring state indicator flag.

DESCRIPTION OF THE PREFERRED EMBODIMENTS

The invention will be described as applied to a power air circuit breaker; however, it also has application to other electrical switching apparatus for opening and closing electric power circuits. For instance, it has application to switches providing a disconnect for branch power circuits and transfer switches used to select alternate power sources for a distribution system. The major difference between a power circuit breaker and these various switches is that the circuit breaker has a trip mechanism which provides overcurrent protection. The invention could also be applied to network protectors which provide protection and isolation for distribution circuits in a specified area.

Figure 1:
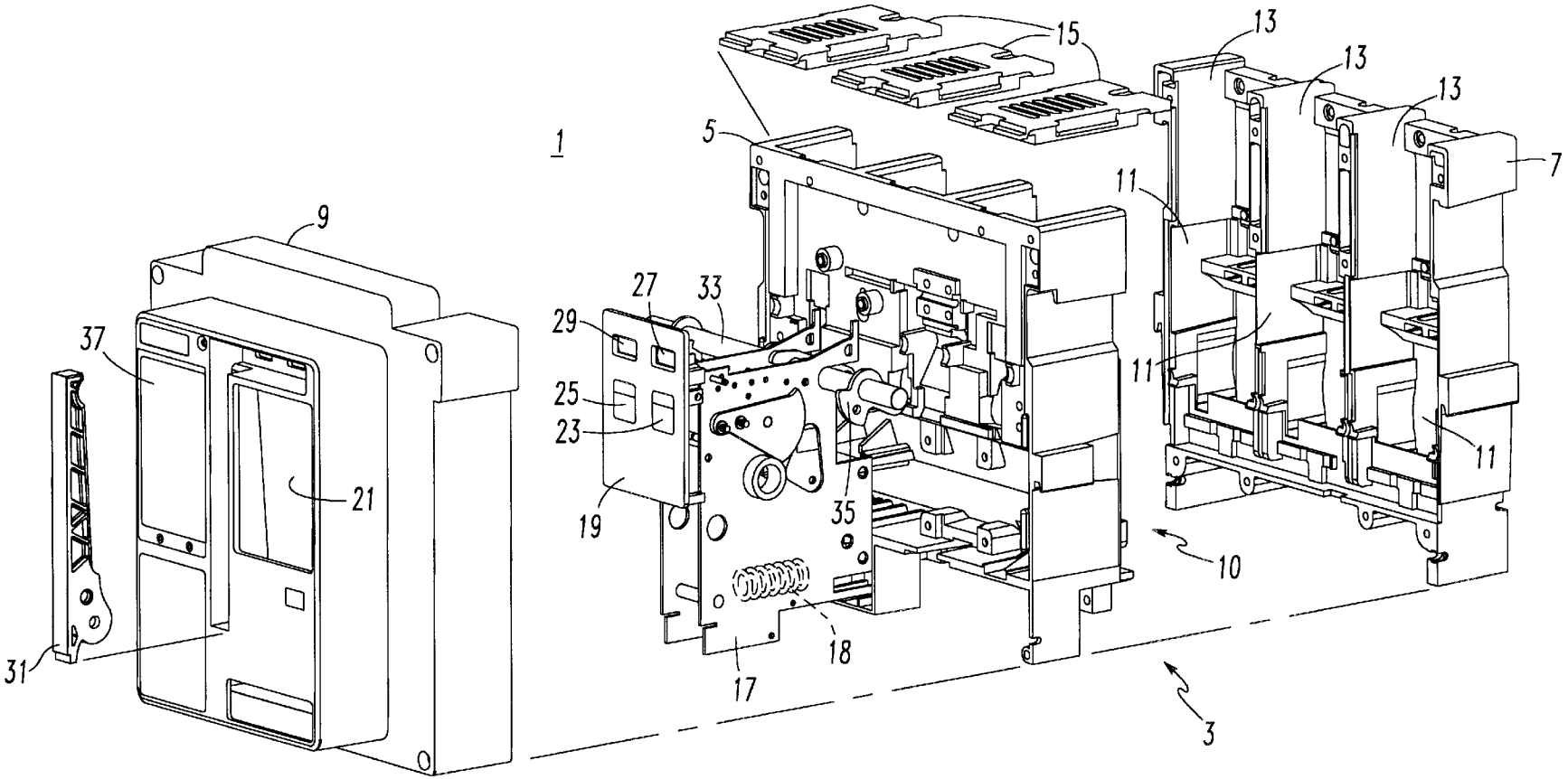
FIG. 1 is an exploded isometric view of a low voltage, high current power circuit breaker in accordance with the invention.

Referring to FIG. 1, the power air circuit breaker 1 of the invention has a housing 3 which includes a molded front casing 5 and a rear casing 7, and a cover 9. The exemplary circuit breaker 1 has three poles 10 with the front and rear casings 5, 7 forming three, pole chambers 11. Each pole 10 has an arc chamber 13 which is enclosed by a ventilated arc chamber cover 15.

Circuit breaker 1 has an operating mechanism 17 which is mounted on the front of the front casing 5 and is enclosed by the cover 9. The operating mechanism 17 has a face plate 19 which is accessible through an opening 21 in the cover. The operating mechanism 17 includes a large spring 18 which is charged to store energy for closing the circuit breaker. Face plate 19 mounts a push to close button 23 which is actuated to discharge the close spring for closing the circuit breaker, and a push to open button 25 for opening the circuit breaker. Indicators 27 and 29 display the condition of the close spring and the open/closed state of the contacts, respectively. The close spring 18 is charged by operation of the charging handle 31 or remotely by a motor operator (not shown).

The common operating mechanism 17 is connected to the individual poles by a pole shaft 33 with a lobe 35 for each pole. As is conventional, the circuit breaker 1 includes an electronic trip unit 37 supported in the cover 9 which actuates the operating mechanism 17 to open all of the poles 10 of the circuit breaker through rotation of the pole shaft 33 in response to predetermined characteristics of the current flowing through the circuit breaker.

Figure 2:
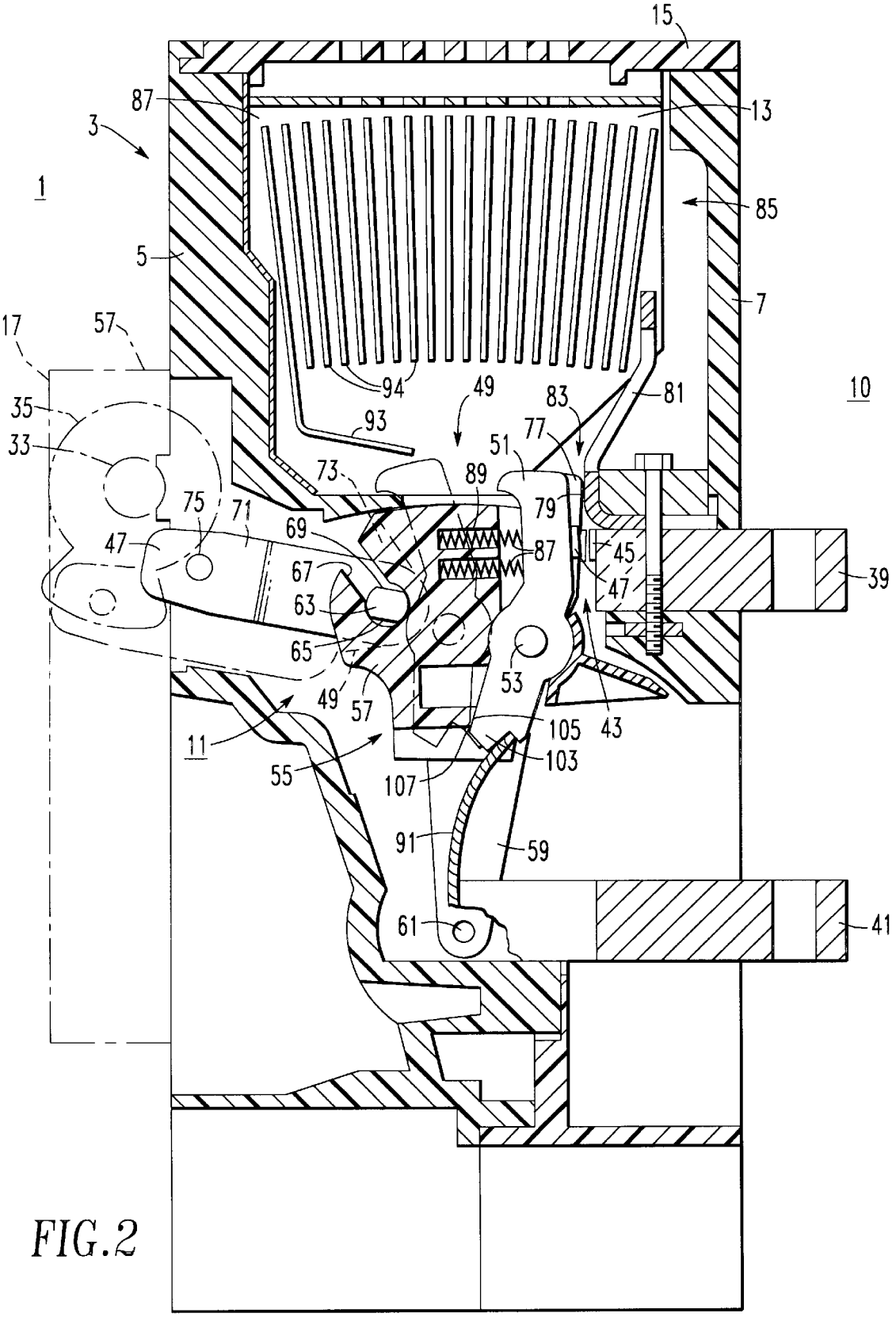
FIG. 2 is a vertical section through a pole of the circuit breaker of FIG. 1 shown as the contacts separate during opening.

FIG. 2 is a vertical section through one of the pole chambers. The pole 10 includes a line side conductor 39 which projects out of the rear casing 7 for connection to a source of ac electric power (not shown). A load conductor 41 also projects out of the rear casing 7 for connection typically to the conductors of the load network (also not shown).

Each pole 10 also includes a pair of main contacts 43 that include a stationary main contact 45 and a moveable main contact 47. The moveable main contact 47 is carried by a moving conductor assembly 49. This moving conductor assembly 49 includes a plurality of contact fingers 51 which are mounted in spaced axial relation on a pivot pin 53 secured in a contact carrier 55. The contact carrier 55 has a molded body 57 and a pair of legs 59 (only one shown) having pivots 61 rotatably supported in the housing 3.

The contact carrier 55 is rotated about the pivots 61 by the drive mechanism 17 which includes a drive pin 63 received in a transverse passage 65 in the carrier body 57 through a slot 67 to which the drive pin 63 is keyed by flats 69. The drive pin 63 is fixed on a drive link 71 which is received in a groove 73 in the carrier body. The other end of the drive link is pivotally connected by a pin 75 to the associated pole arm 35 on the pole shaft 33 similarly connected to the carriers (not shown) in the other poles of the circuit breaker. The pole shaft 33 is rotated by the operating mechanism 17 in a manner to be described.

A moving main contact 47 is fixed to each of the contact fingers 51 at a point spaced from the free end of the finger. The portion of the contact finger adjacent the free end forms a moving arcing contact or "arc toe" 77. A stationary arcing contact 79 is provided on the confronting face of an integral arcing contact and runner 81 mounted on the line side conductor 39. The stationary arcing contact 79 and arc toe 77 together form a pair of arcing contacts 83. The integral arcing contact and runner 81 extends upward toward a conventional arc chute 85 mounted in the arc chamber 13.

The contact fingers 51 are biased clockwise as seen in FIG. 2 on the pivot pin 53 of the carrier 55 by pairs of helical compression springs 87 seated in recesses 89 in the carrier body 55. The operating mechanism 17 rotates the pole shaft 33 which in turn pivots the contact carrier 55 clockwise to a closed position (not shown) to close the main contacts 43. To open the contacts, the operating mechanism 17 releases the pole shaft 33 and the compressed springs 87 accelerate the carrier 55 in a counterclockwise direction to an open position (not shown). As the carrier is rotated clockwise toward the closed position, the arc toes 77 contact the stationary arcing contacts 79 first. As the carrier continues to move clockwise, the springs 87 compress as the contact fingers 51 rock about the pivot pin 53 until the main contacts 43 close. Further clockwise rotation to the fully closed position (not shown) results in opening of the arcing contacts 83 while the main contacts 43 remain closed. In that closed position, a circuit is completed from the line conductor 39 through the closed main contacts 43, the contact fingers 51, flexible shunts 91, and the load conductor 41.

To open the circuit breaker 1, the operating mechanism 17 releases the pole shaft 33 so that the compressed springs 87 accelerate the carrier 55 counterclockwise as viewed in FIG. 2. Initially, as the carrier 55 moves away from the line conductor 39, the contact fingers 51 rock so that the arcing contacts 83 close while the main contacts 43 remain closed. As the carrier 55 continues to move counterclockwise, the main contacts 43 open and all of the current is transferred to the arcing contacts 83 which is the condition shown in FIG. 2. If there is a sizeable current being carried by the circuit breaker such as when the circuit breaker trips open in response to an overcurrent or short circuit, an arc is struck between the stationary arcing contacts 79 and the moveable arcing contacts or arc toes 77 as these contacts separate with continued counterclockwise rotation of the carrier 55. As the main contacts 43 have already separated, the arcing is confined to the arcing contacts 83 which preserves the life of the main contacts 43. The electromagnetic forces produced by the current sustained in the arc push the arc outward toward the arc chute 85 so that the end of the arc at the stationary arc contact 79 moves up the integral arcing contact and runner 81 and into the arc chute 85. At the same time, the rapid opening of the carrier 55 brings the arc toes 77 adjacent the free end of the arc top plate 93 as shown in phantom in FIG. 2 so that the arc extends from the arc toes 77 to the arc top plate 93 and moves up the arc top plate into the arc plates 94 which break the arc up into shorter sections which are then extinguished.

Figure 3:
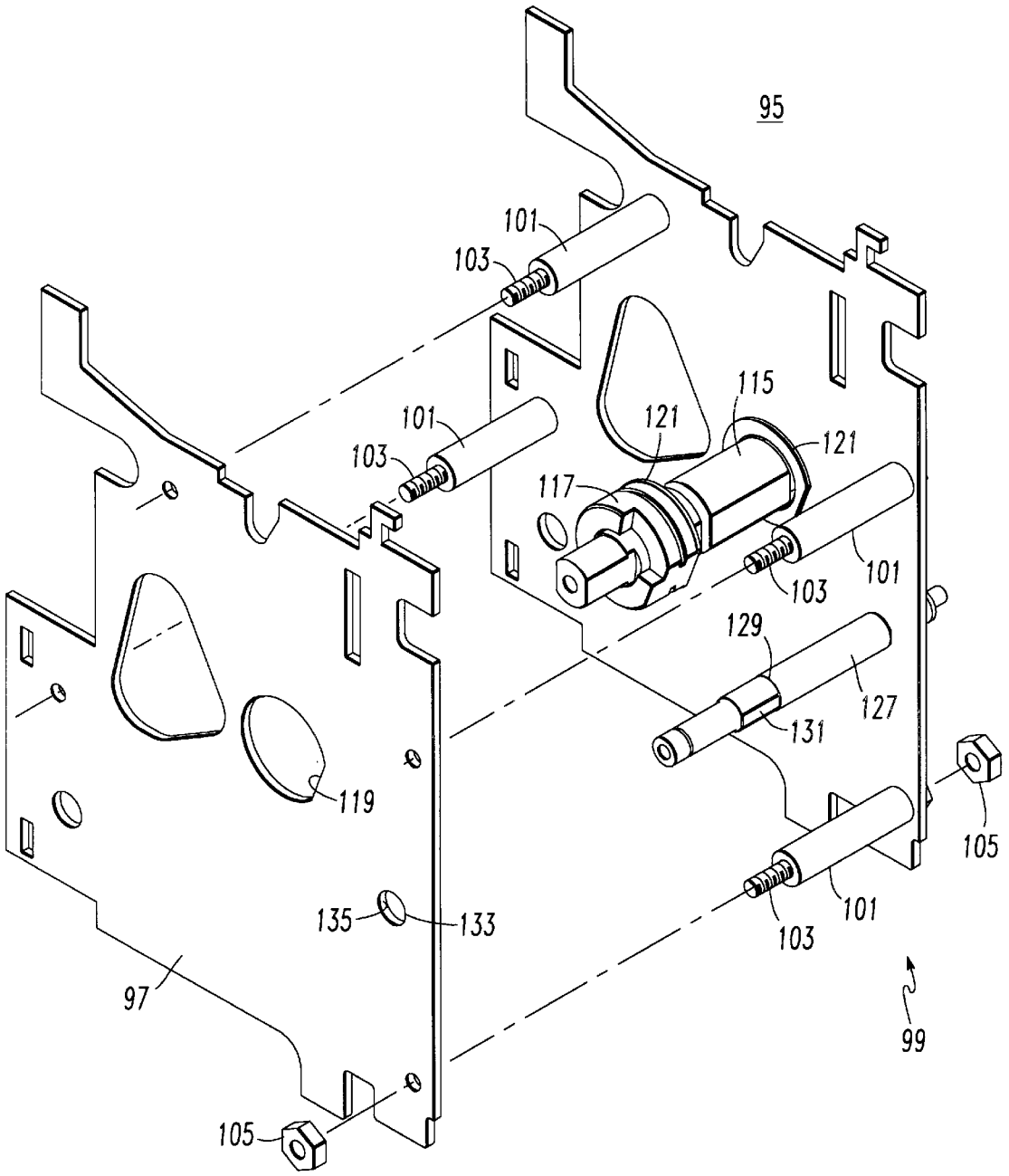
FIG. 3 is an exploded isometric view of a cage assembly which forms part of the operating mechanism of the circuit.
Figure 4:
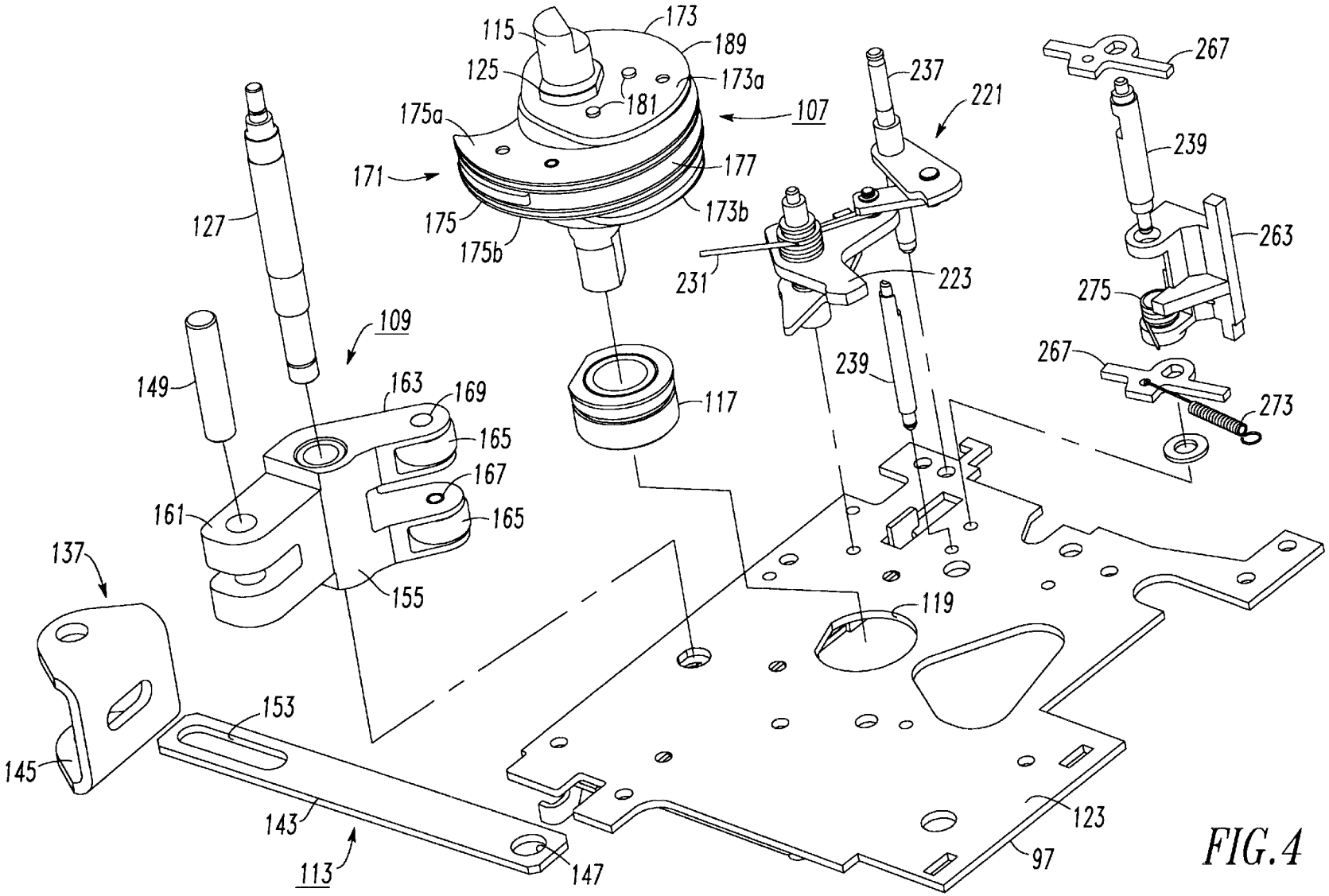
FIG. 4 is an exploded isometric view illustrating assembly of the operating mechanism.
Figure 5:
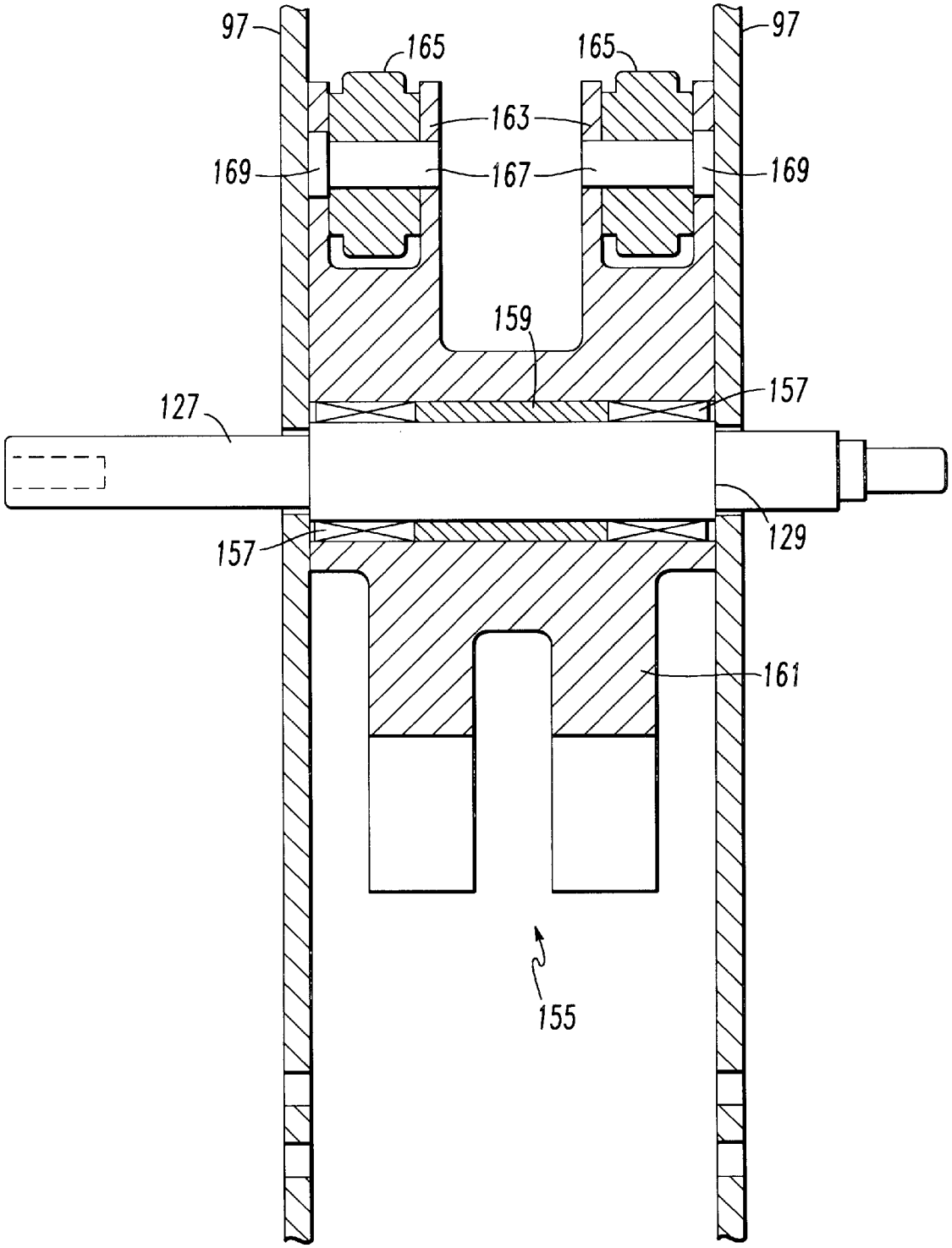
FIG. 5 is a partial vertical sectional view through an assembled operating mechanism taken through the rocker assembly.

The operating mechanism 17 is a self supporting module having a cage 95. As shown in FIG. 3, the cage 95 includes two side plates 97 which are identical and interchangeable. The side plates 97 are held in spaced relation by four elongated members 99 formed by spacer sleeves 101, and threaded shafts 103 and nuts 105 which clamp the side plates 97 against the spacer sleeves 101. Four major subassemblies and a large spring 18 make up the power portion of the operating mechanism 17. The four major subassemblies are the cam assembly 107, the rocker assembly 109, the main link assembly 111 and a close spring support assembly 113. All of these components fit between the two side plates 97. Referring to FIGS. 3 and 4, the cam assembly 107 includes a cam shaft 115 which is journaled in non-cylindrical bushings 117 seated in complementary non-cylindrical openings 119 in the side plates 97. The bushings 117 have flanges 121 which bear against the inner faces 123 of the side plates 97 and the cam shaft 115 has shoulders 125 which position it between the bushings 117 so that the cam shaft 115 and the bushings 117 are captured between the side plates 97 without the need for fasteners. Similarly, a rocker pin 127 of the rocker assembly 109 has shoulders 129 which capture it between the side plates as seen in FIGS. 3–5. Flats 131 on the rocker pin 127 engages similar flats 133 in openings 135 in the side plates 97 to prevent rotation of the rocker pin. The cam shaft 115 and rocker pin 127 add stability to the cage 95 which is self-aligning and needs no special fixturing for alignment of the parts during assembly. As the major components are "sandwiched" between the two side plates 97, the majority of the components need no additional hardware for support. As will be seen, this sandwich construction simplifies assembly of the operating mechanism 17.

Figure 6:
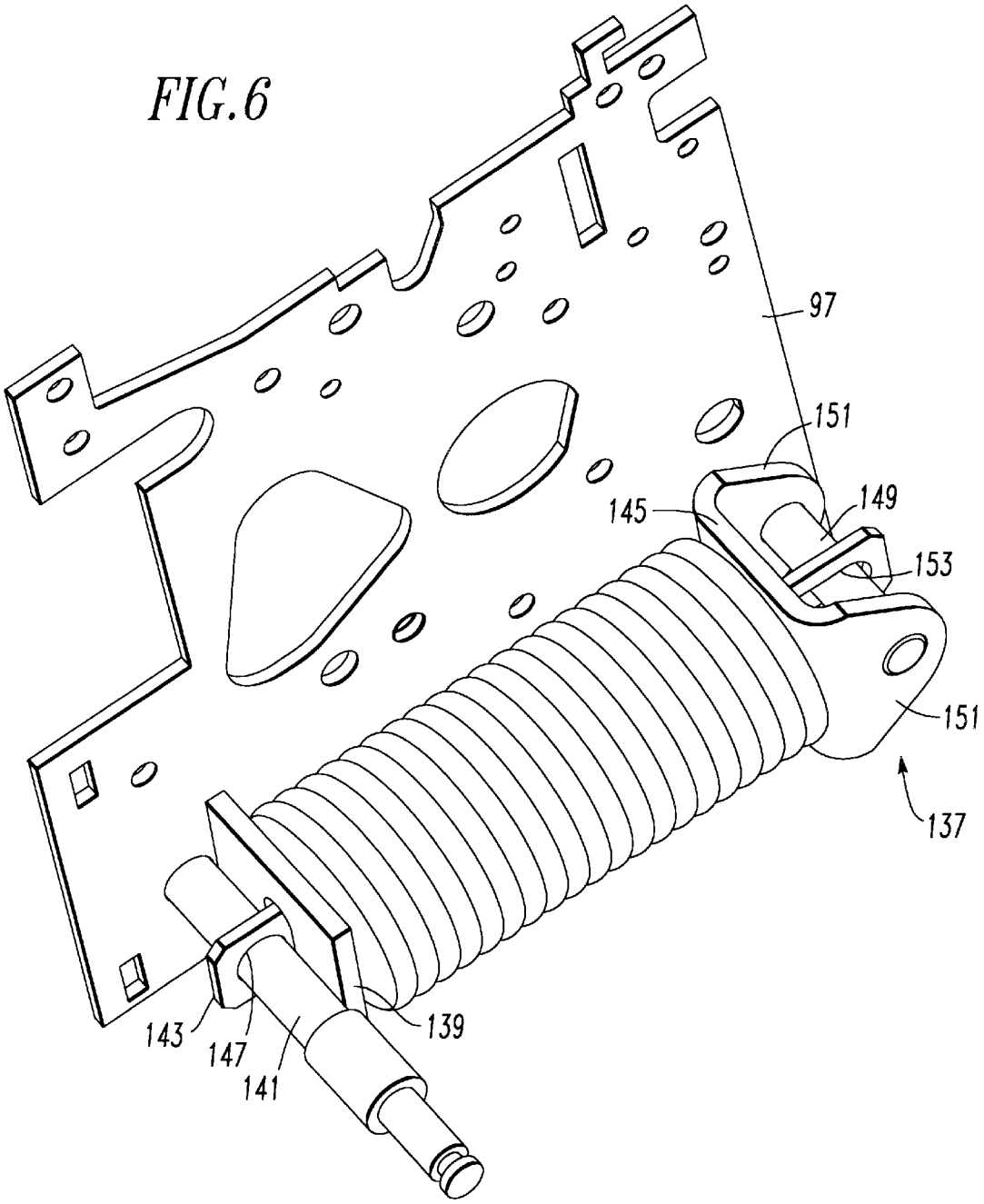
FIG. 6 is an isometric view illustrating the mounting of the close spring which forms part of the operating mechanism.

The close spring 18 is a common, round wire, heavy duty, helical compression spring closed and ground flat on both ends. A compression spring is used because of its higher energy density than a tension spring. The helical compression close spring 18 is supported in a very unique way by the close spring support assembly 113 in order to prevent stress risers and/or buckling. In such a high energy application, it is important that the ends of the spring 18 be maintained parallel and uniformly supported and that the spring be laterally held in place. As illustrated particularly in FIGS. 4 and 6, and also in FIGS. 8-11, this is accomplished by compressing the helical compression close spring 18 between a U bracket 137 which is free to rotate and also drive the rocker assembly 109 at one end, and a nearly square spring washer or guide plate 139 which can pivot against a spring stop or support pin 141 which extends between the slide plates 97 at the other end. The spring 18 is kept from "walking" as it is captured between the two side plates 97, and is laterally restrained by an elongated guide member 143 that extends through the middle of the spring, the spring washer 139 and the brace 145 of the U bracket 137. The elongated guide member 143 in turn is captured on one end by the spring stop pin 141 which extends through an aperture 147, and on the other end by a bracket pin 149 which extends through legs 151 on the U bracket 137 and an elongated slot 153 in the elongated member.

The rocker assembly 109 includes a rocker 155 pivotally mounted on the rocker pin 127 by a pair of roller bearings 157 which are captured between the side plates 97 and held in spaced relation by a sleeve 159 as best seen in FIG. 5. The rocker 155 has a clevis 161 on one end which pivotally connects the rocker 155 to the U bracket 137 through the bracket pin 149. A pair of legs 163 on the other end of the rocker 155 which extend at an obtuse angle to the clevis 161, form a pair of roller devises which support rocker rollers 165. The rocker rollers 165 are pivotally mounted to the roller devises by pins 167. These pins 167 have heads 169 facing outwardly toward the side plates 97 so that they are captured and retained in place without the need for any snap rings or other separate retainers. As the rocker 155 rocks about the rocker pin 127, the spring washer 139 rotates on the spring support shaft 141 so that the loading on the spring 18 remains uniform regardless of the position of the rocker 155. The spring 18, spring washer 139 and spring support pin 141 are the last items that go into a finished mechanism 17 so that the spring 18 can be properly sized for the application.

The U bracket pin 149 transfers all of the spring loads and energy to the rocker clevis 161 on the rocker 155. The translational loads on the rocker 155 are transferred into the non-rotating rocker pin 127 and from there into the two side plates 97 while the rocker 155 remains free to rotate between the plates 97.

Referring to FIGS. 4–11, the cam assembly 107 includes in addition to the cam shaft 115, a cam member 171. The cam member 171 includes a charge cam 173 formed by a pair of charge cam plates **173*a*, 173*b* mounted on the cam shaft 115. The charge cam plates 173*a*, 173*b* straddle a drive cam 175 which is formed by a second pair of cam plates 175*a*, 175*b*. A cam spacer 177 sets the spacing between the drive cam plates 175*a*, 175*b* while spacer bushings 179 separate the charge cam plates 173*a*, 173*b* from the drive cam plates and from the side plates 97. The cam plates 173, 175 are all secured together by rivets 181 extending through rivet spacers 183 between the plates. A stop roller 185 is pivotally mounted between the drive cam plates 175*a* and 175*b* and a reset pin 187 extends between the drive cam plate 175*a* and the charge cam plate 173*a*. The cam assembly 107 is a 360° mechanism which compresses the spring 18 to store energy during part of the rotation, and which is rotated by release of the energy stored in the spring 18 during the remainder of rotation. This is accomplished through engagement of the charge cam plates 173*a*, 173*b* by the rocker rollers 165. The preload on the spring 18 maintains the rocker rollers 165 in engagement with the charge cam plates 173*a*, 173*b*. The charge cam 173 has a cam profile 189 with a charging portion 189*a* which at the point of engagement with the rocker rollers 165 increases in diameter with clockwise rotation of the cam member 171. The cam shaft 115 and therefore the cam member 171 is rotated either manually by the handle 31 or by an electric motor 421 (see FIG. 33) in a manner to be described. The charging portion 189*a* of the charge cam profile 189 is configured so that a substantially constant torque is required to compress the spring 18**. This provides a better feel for manual charging and reduces the size of the motor required for automatic charging as the constant torque is below the peak torque which would normally be required as the spring approaches the fully compressed condition.

The cam profile 189 on the charge cam 173 also includes a closing portion **189*b* which decreases in diameter as the charge cam 173 rotates against the rocker rollers 165 so that the energy stored in the spring 18 drives the cam member 171** clockwise when the mechanism is released in a manner to be discussed.

The drive cam 175 of the cam member 171 has a cam profile 191 which in certain rotational positions is engaged by a drive roller 193 mounted on a main link 195 of the main link assembly 111 by a roller pin 197. The other end of the main link 195 is pivotally connected to a drive arm 199 on the pole shaft 33 by a pin 201. This main link assembly 111 is coupled to the drive cam 175 for closing the circuit breaker 1 by a trip mechanism 203 which includes a hatchet plate 205 pivotally mounted on a hatchet pin 207 supported by the side plates 97 and biased counterclockwise by a spring 219. A banana link 209 is pivotally connected at one end to an extension on the roller pin 197 of the main link assembly and at the other end is pivotally connected to one end of the hatchet plate 205. The other end of the hatchet plate 205 has a latch ledge 211 which engages a trip D shaft 213 when the shaft is rotated to a latch position. With the hatchet plate 205 latched, the banana link 209 holds the drive roller 193 in engagement with the drive cam 175. In operation, when the trip D shaft 213 is rotated to a trip position, the latch ledge 211 slides off of the trip D shaft 213 and the hatchet plate 205 passes through a notch 215 in the trip D shaft which repositions the pivot point of the banana link 209 connected to the hatchet plate 205 and allows the drive roller 193 to float independently of the drive cam 175.

Figure 8:
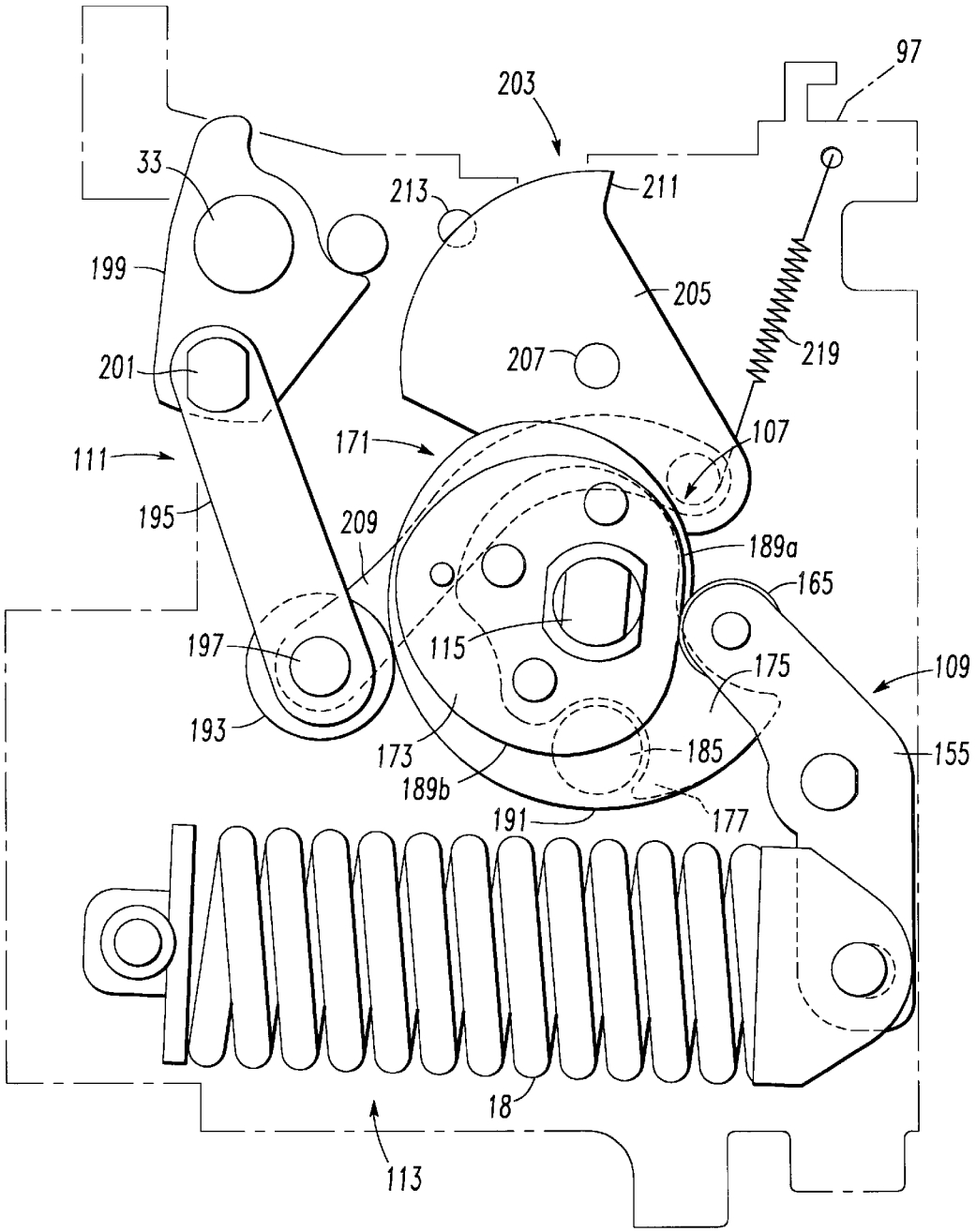
FIG. 8 is an elevation view illustrating the relationship of the major components of the operating mechanism shown with the contacts open and the close spring discharged.

The sequence of charging and discharging the close spring 18 can be understood by reference to FIGS. 8–11. In FIG. 8 the mechanism is shown in the discharged open position, that is, the close spring 18 is discharged and the contacts 43 are open. It can be seen that the cam member 171 is positioned so that the charge cam 173 has its smallest radius in contact with the rocker rollers 165. Thus, the rocker 155 is rotated to a full counterclockwise position and the spring 18 is at its maximum extension. It can also be seen that the trip mechanism 203 is not latched so that the drive roller 193 is floating although resting against the drive cam 175. As the cam shaft 115 is rotated clockwise manually by the handle 31 or through operation of the charge motor 421 the charge portion 189*a* of the charge profile on the charge cam which progressively increases in diameter, engages the rocker roller 165 and rotates the rocker 155 clockwise to compress the spring 18. As mentioned, the configuration of this charge portion 189*a* of the profile is selected so that a constant torque is required to compress the spring 18. During this charging of the spring 18, the driver roller 193 is in contact with a portion of the drive cam profile 191 which has a constant radius so that the drive roller 193 continues to float.

Figure 9:
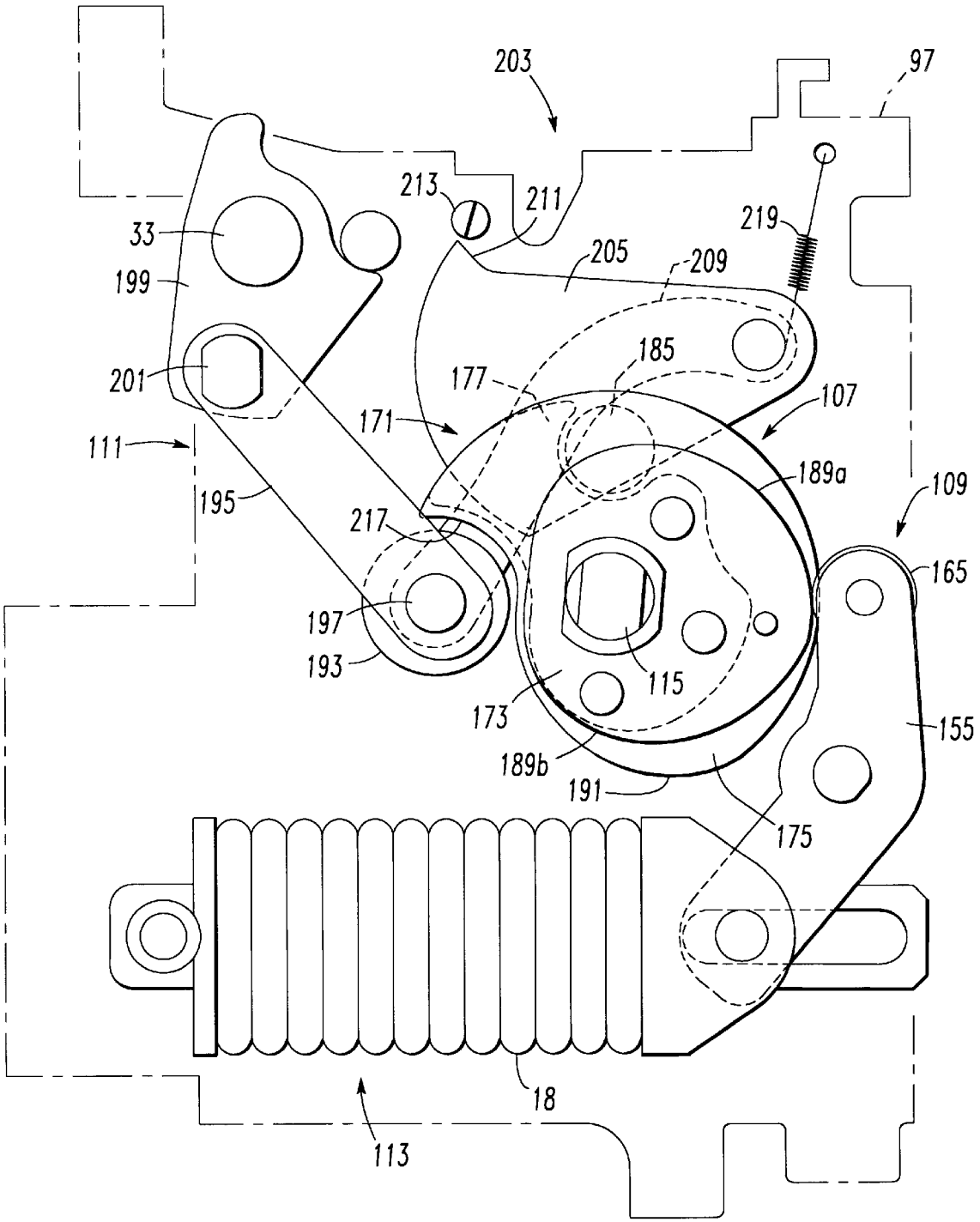
FIG. 9 is a view similar to FIG. 8 shown with the contacts open and the close spring charged.
Figure 10:
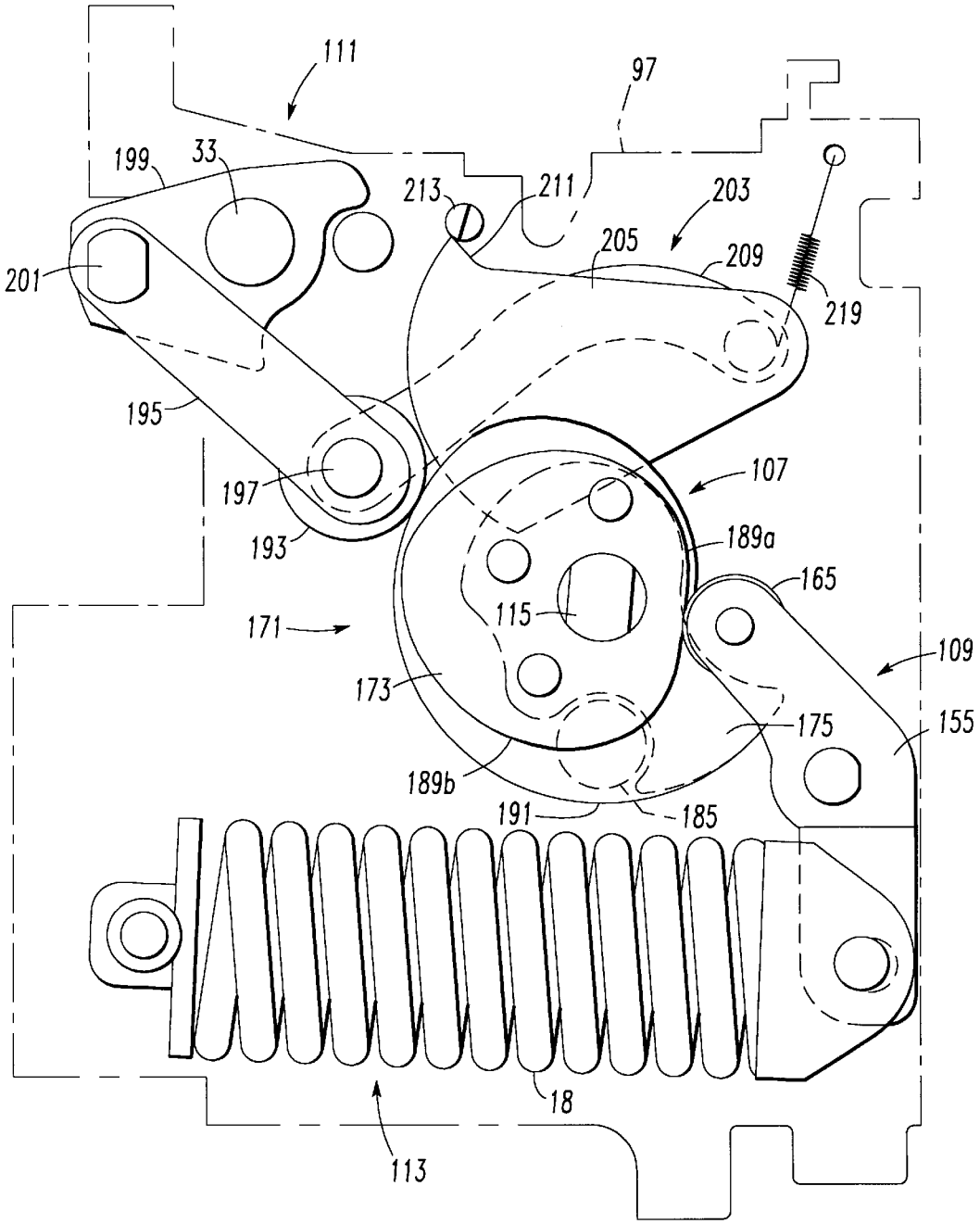
FIG. 10 is a view similar to FIG. 8 shown with the contacts closed and the close spring discharged.

Moving now to FIG. 9, as the spring 18 becomes fully charged, the drive roller 193 falls off of the drive cam profile 191 into a recess 217. This permits the reset spring 219 to rotate the hatchet plate 205 counterclockwise until the latch ledge 211 passes slightly beyond the trip D shaft 213. This raises the pivot point of the banana link 209 on the hatchet plate 205 so that the drive roller 193 is raised to a position where it rests beneath the notch 217 in the drive cam 175. At the same time, the rocker rollers 165 reach a point just after 170° rotation of the cam member where they enter the close portion 189*b* of the charge cam profile 189. On this portion 189*b* of the charge cam profile, the radius of the charge cam 173 in contact with the rocker rollers 165 decreases in radius with clockwise rotation of the cam member 171. Thus, the close spring 18 applies a force tending to continue rotation of the cam member 171 in the clockwise direction. However, a close prop (not shown in FIG. 9) which is part of a close prop mechanism to be described later, engages the stop roller 185 and prevents further rotation of the cam member 171. Thus, the spring 18 remains fully charged ready to close the contacts 43 of the circuit breaker 1.

The contacts 43 of the circuit breaker 1 are closed by release of the close prop in a manner to be described. With the close prop disengaged from the stop roller 185, the spring energy is released to rapidly rotate the cam member 171 to the position shown in FIG. 10. As the cam member 171 rotates, the drive roller 193 is engaged by the cam profile 191 of the drive cam 175. The radius of this cam profile 191 increases with cam shaft rotation and since the banana link 209 holds the drive roller 193 in contact with this surface, the pole shaft 33 is rotated to close the contacts 43 as described in connection with FIG. 2. At this point the latch ledge 211 engages the D latch 213 and the contacts are latched closed. If the circuit breaker is tripped at this point by rotation of the trip D shaft 213 so that this latch ledge 211 is disengaged from the D shaft 213, the very large force generated by the compressed contact springs 87 (see FIG. 2) exerted through the main link 195 pulls the pivot point of the banana link 209 on the hatchet plate 205 clockwise downward and the drive roller 193 drops free of the drive cam 175 allowing the pole shaft 33 to rotate and the contacts 43 to open. With the contacts 43 open and the spring 18 discharged the mechanism would again be in the state shown in FIG. 8.

Figure 11:
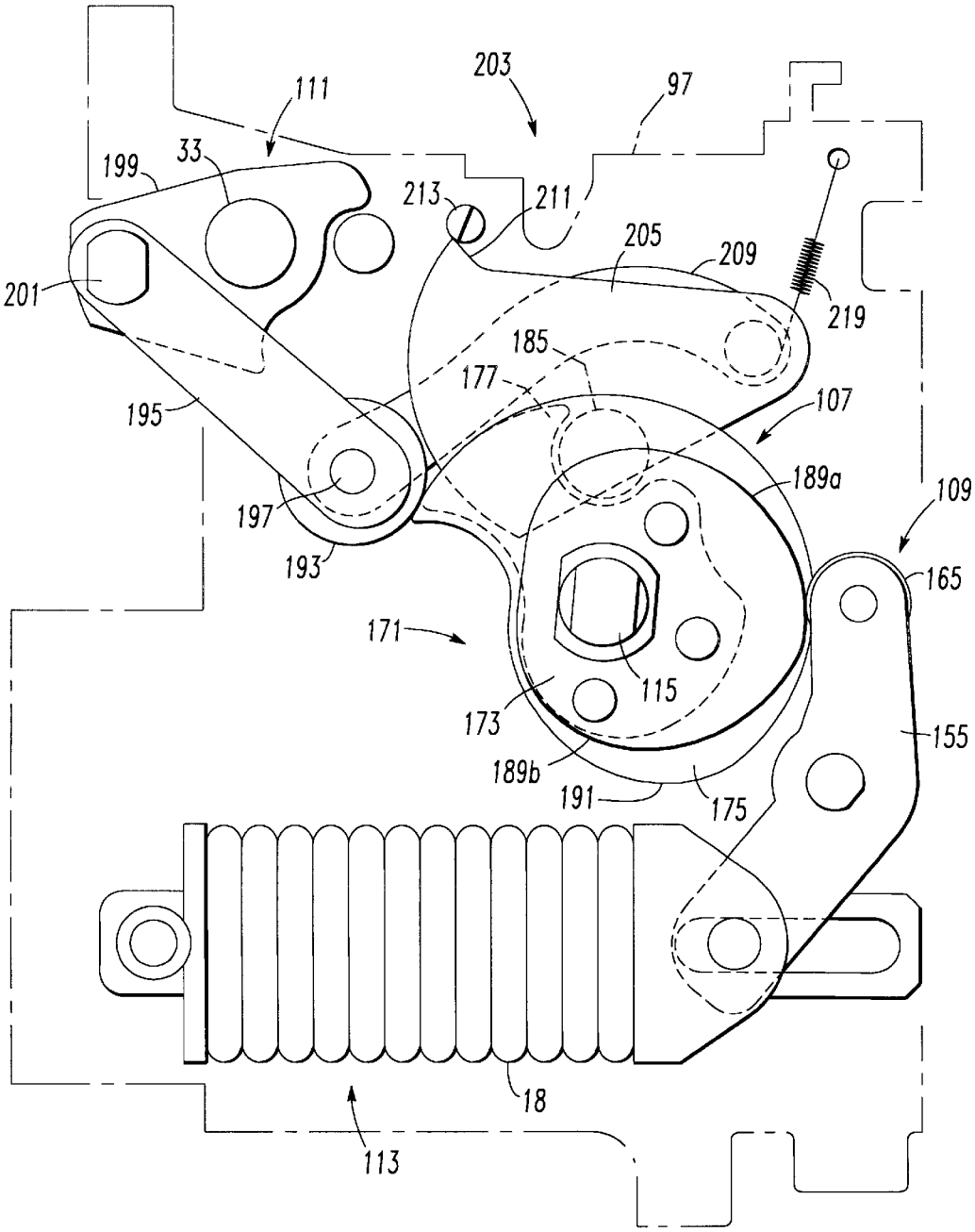
FIG. 11 is a view similar to FIG. 8 shown with the contacts closed and the close spring charged.

Typically, when the circuit breaker is closed, the close spring 18 is recharged, again by rotation of the cam shaft 115 either manually or electrically. This causes the cam member 171 to return to the same position as in FIG. 9, but with the trip mechanism 203 latched, the banana link 209 keeps the drive roller 193 engaged with the drive profile 191 on the drive cam 175 as shown in FIG. 11. If the circuit breaker is tripped at this point by rotation of the trip D latch 213 so that the hatchet plate 205 rotates clockwise, the drive roller 193 will drop down into the notch 217 in the drive cam 175 and the circuit breaker will open.

As mentioned, during the first 180° of rotation of the cam member 171, the spring 18 is being charged and during the second 180° of rotation the energy in the spring is being delivered to the contact structure at a controlled rate. In other words, during the latter phase, the spring 18, the cam member 171 and drive roller 193 are acting like a motor. As discussed, it is desirable to provide a constant charging torque both for the manual charge because it provides a better "feel" to the operator, and for the electric operator which can be sized for constant torque rather than peak torque. During the first 10° of charging, the torque is ramped up to the selected constant value. This provides a user friendly feel instead of letting a person hit a wall of constant torque. It also allows the charging motor, if used, to get up to speed before reaching maximum torque. During the last 10° of the charging cycle, the torque is reduced from a maximum positive torque to a slightly negative torque. This allows the cam assembly 107, and specifically the stop roller 185 and the close prop 223, to rest against each other for the closing half of the cycle. The profile 189 of the charge cam 173 is designed so that the force between the roller 185 and the prop 223 is a negative 5 to 15 pounds, depending upon the size of the compression spring 18. Once the close prop 223 is removed, the cam assembly 107 begins rotating the remaining 180° due to the force of the spring 18 and the slope of the charge cam closing profile 189*b*.

The close cam profile 189*b* between 180° and 360° is very critical for the optimum operation of the circuit breaker and is a unique feature of the invention. In prior art mechanisms, without a drive cam 175, it is common to simply release the spring energy and let the contacts 43 slam closed. The spring 18 is usually sized to close the contacts 43 quickly and without contact bounce. These goals can be incompatible and compromises are made. However, with the close cam 173 of the invention it is possible to control the release of energy to the moving conductor assembly 49. This close cam profile 189*b* can be selected so that the contacts can be closed quickly, firmly, and with no contact bounce. We have found that at least 50% of the energy stored in the spring 18 should be released prior to contact closure, and in fact prior to contact of the arcing contacts 83. Preferably, about 70% of the energy is released before the contacts begin to touch. A computer simulation can be used to optimize the cam profiles 189, 191. In most applications, the charging portion of the charge cam profile 189*a* should remain about the same. However, the closing portion of the charge cam profile 189*b* is unique for the moving conductor assembly 49 (mass and geometry) and for the type of contacts 43, 83 being used.

Because of the high energies and forces associated with the drive mechanism, hardened stainless steel close cams 173 and drive cams 175 are used. However, it should be noted that all forces are balanced about the center plane of the cam assembly 107 through use of the duel charge cams 173*a*, 173*b* straddling the symmetrical drive cam 175 to prevent warping and twisting. Symmetrical loading is believed important to make a durable mechanism.

Figure 12:
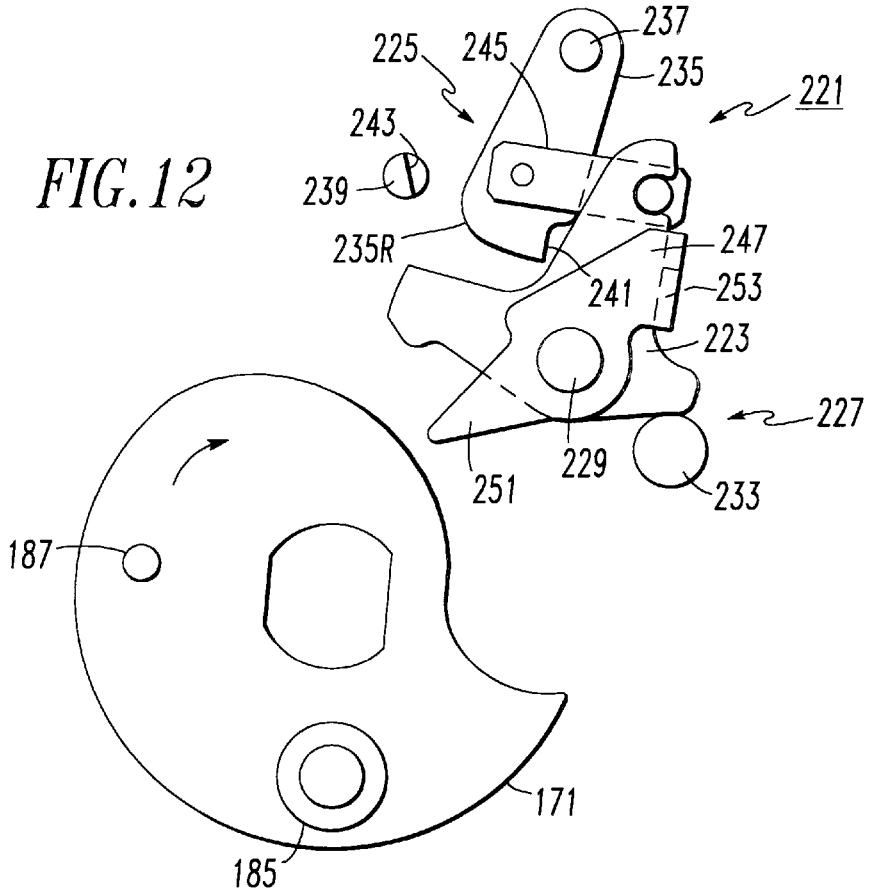
FIG. 12 is an elevation view of the close prop which controls release of the close spring shown in relation to the cam member of the operating mechanism with the close spring discharged and the close prop released.

The close prop mechanism 221 is illustrated in FIGS. 12–16. This mechanism includes the close prop 223, a latch assembly 225 and a reset device 227. As mentioned, the close prop 223 engages the stop roller 185 on the cam member 171 to hold the close spring 18 in the charged condition. The pivot pin 229 for the close prop 223 is positioned exactly in the line of force exerted by the stop roller 185 on the close prop 223 to minimize the unlatching force and to reduce the likelihood of shock out (the unintentional opening of the contacts due to vibration or shock). A large torsion spring 231 (see FIGS. 4 and 16) biases the close prop 223 to the release position against a stop 233 as shown in FIG. 12. It is held in the latched position illustrated in FIG. 14 by the latch assembly 225. This latch assembly 225 includes a close latch plate 235 pivotally mounted on a latch plate support shaft 237 supported in the side plates 97, and a close spring latch pin in the form of a close D latch shaft 239 journaled in the side plates. The close latch plate 235 has a latch ledge 241 which engages the close D latch shaft 239 with the latter in the cocked position, but falls through a notch 243 in the close D latch shaft 239 when the shaft is rotated to a release position. The latch assembly 225 also includes a latch link 245 connecting the close prop 223 to the close latch plate 235. With the close latch plate 235 engaged by the close D latch shaft 239, the close prop 223 is rotated to the stop or reset position shown in FIG. 14. When the close D latch shaft 239 is rotated to the release position, the close latch plate 235 falls through the notch 243 and the torsion spring 231 rotates the close prop 223 clockwise to the release position shown in FIG. 15 pulling the close latch plate 235 with it.

Figure 13:
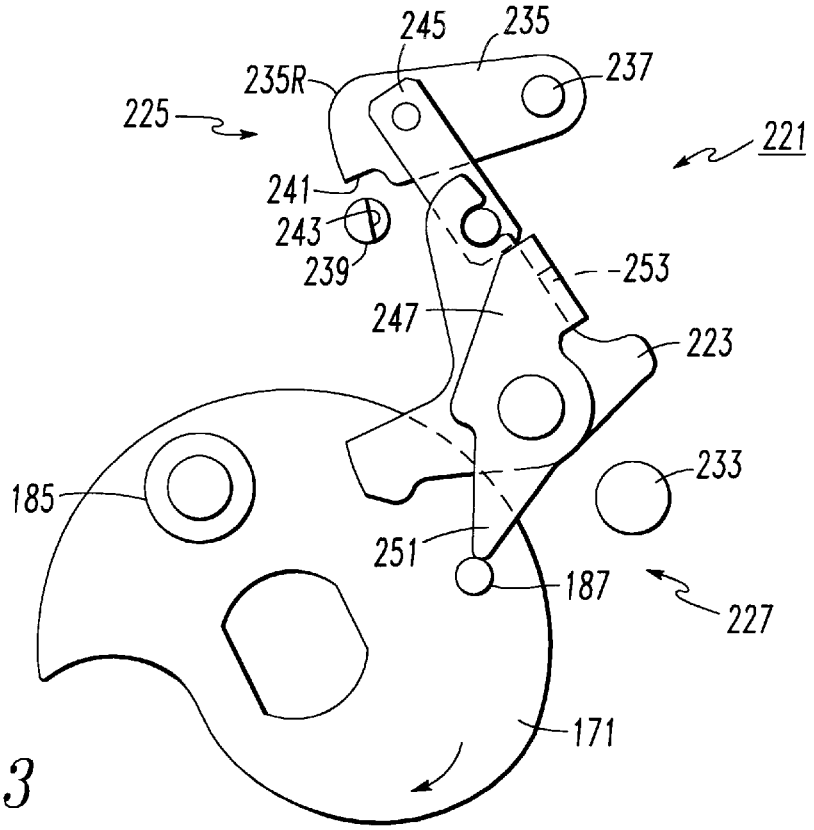
FIG. 13 is a view similar to FIG. 12 shown during charging of the close spring as the close prop is being reset.

The reset device 227 for the close prop mechanism 221 includes a reset lever 247 which is pivotally mounted on the same shaft 229 as the close prop 223 but is rotatable independently of the close prop. The reset device 227 also includes a reset member in the form of the reset pin 187 provided between the close cam plate 173*a* and drive cam plate 175*a* in advance of the stop roller 185 in the direction of rotation. With the close prop mechanism 221 unlatched as shown in FIG. 12, the close prop 223 is biased against the stop 233 by the torsion spring 231. As the cam member 171 rotates to charge the spring, the reset pin 187 engages a finger 251 on the reset lever 247. As shown in FIG. 13, clockwise rotation of the cam member 171 causes counterclockwise rotation of the reset lever. The reset lever 247 has a flange 253 which engages the close prop 223 so that the close prop rotates with the reset lever. Alternatively, of course, the close prop 223 could have a flange engaged by the reset lever 247. The link 245 pushes the close latch plate 235 toward the close D latch shaft 239 and the rounded corner 235R on the close latch plate 235 rotates the close D latch shaft 239 to allow the latch shaft to pass through the notch 243. When the close latch plate 235 passes above the close D latch shaft 239, the latter rotates back so that as the reset lever 247 slides off of the reset pin 187 and the torsion spring 231 biases the close prop 223 clockwise, the latch ledge 241 engages the close D latch shaft 239 to maintain the close prop 223 in the reset or latched position shown in FIG. 14. As mentioned, the reset lever 247 can rotate independently of the close prop 223, but it is biased against the close prop by a second torsion spring 255 (see FIG. 16). However, since the manual charging system has a ratchet which allows the cam assembly 107 to backoff during recycling of the handle 31, the reset pin 187 can engage the reset lever 247 and rotate it clockwise against the bias force of the second torsion spring 255 and away from the latched close prop 223. This is an important feature of the invention as it prevents damage to the close prop mechanism 221.

Figure 17:
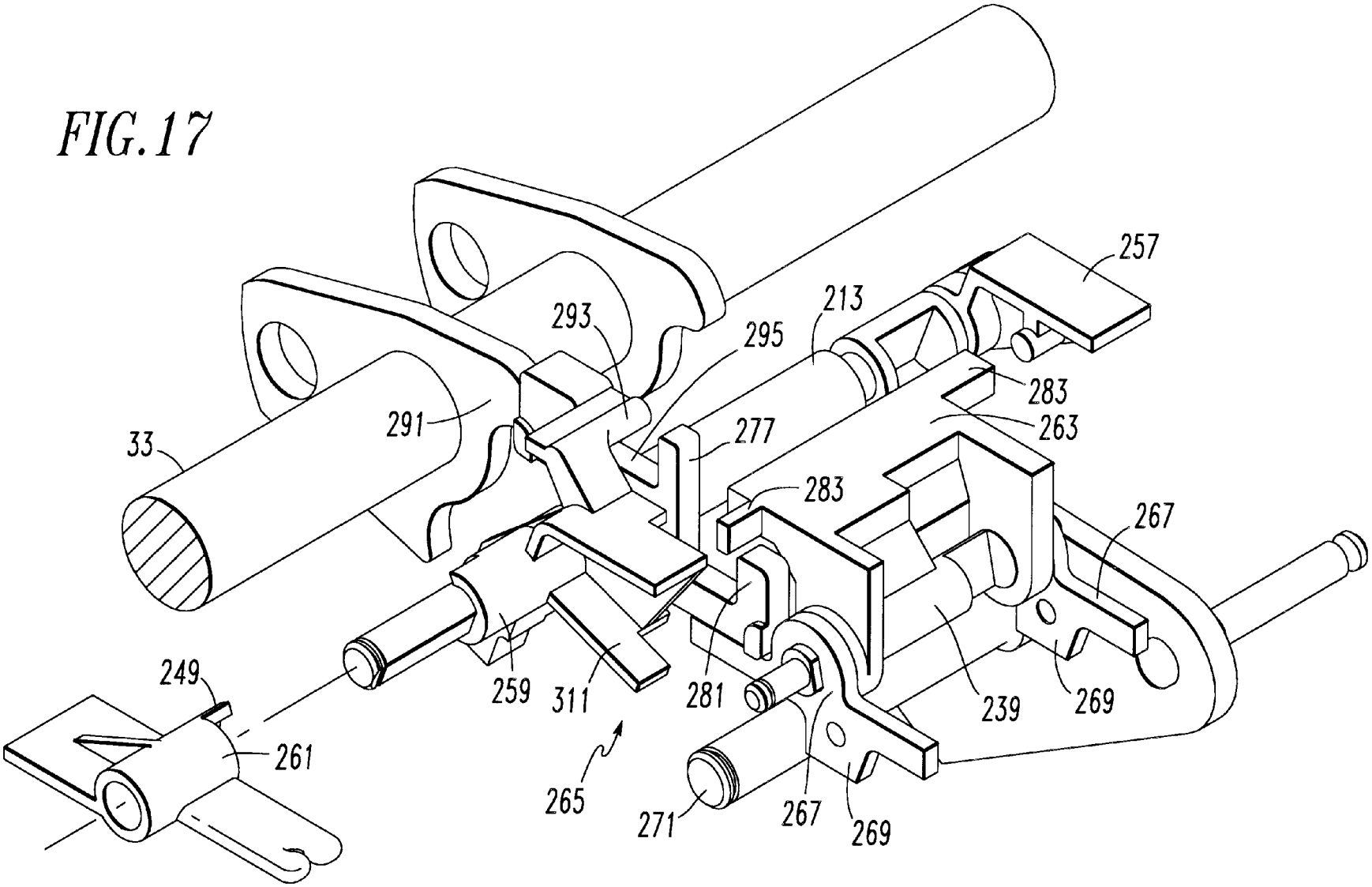
FIG. 17 is an isometric view of the interlock assembly which interlocks operation of the trip D latch and the close D latch.

The trip D latch shaft 213, which as described is rotated to open the circuit breaker, is completely supported by the two side plates 97 as shown in FIG. 17. It is located at the very top of the mechanism 17 and has one snap-on molded plastic platform 257 on one end and two additional platforms 259 and 261 on the other end, all outboard of the side plates 97. Molded plastic platforms 257 and 259 are keyed to flats on each end of the trip D latch shaft 213 outboard of the side plates 97. The platform 261 is freely rotatable on the trip D latch shaft 213, but has an extension 249 which engages the platform 259 to couple it to the trip D latch shaft. These molded platforms are engaged by solenoids to rotate the trip D latch shaft 213 to open the circuit breaker in the manner discussed above. The platform 257 is engaged by an under-voltage solenoid (if provided). The platform 259 is rotated by an auxiliary trip solenoid (not shown, and if provided) which can be actuated from a remote location. The platform 261 is engaged by a trip actuator (not shown, and if provided) energized by the trip unit 37 in response to an overcurrent or short circuit condition in the protected circuit.

As can be seen in FIG. 17, the close D latch shaft 239 extends parallel to the trip D latch shaft 213 near the top of the mechanism 17 and is also completely supported by the side plates 97. Referring also to FIGS. 18 through 21, a molded close release platform 263 is mounted on but rotates free of the close D latch shaft 239. This is because the close release platform 263 is part of an interlock mechanism 265 which gives preference to tripping the contacts 43 open. This interlock mechanism 265 includes a pair of close spring release levers 267 keyed to the close D latch shaft 239 outside of the close release platform 263. These close spring release levers 267 each have stops 269 extending transversely from the levers. The stops 269 are biased against a stop shaft 271 to hold the close D latch shaft 239 in the cocked position by a tension spring 273 (see FIG. 4). The close release platform 263 is biased clockwise to the horizontal position shown in FIG. 18 by a torsion spring 275 (also FIG. 4). An interlock member 277 in the form of a slide is interposed between the close spring release platform 263 and the close spring release lever 267 on one side. The elongated slide 277 is loosely mounted on the trip D latch shaft 213 which extends through an elongated slot 279. The slide 277 has a projection 281 on one end which when the slide is in a first position shown in FIG. 18 is aligned with a finger 283 on the close spring release platform 263. Thus, with the slide 277 in this position, rotation of the close spring release platform 263 downward such as by a close solenoid 285 causes the finger 283 to engage the projection 281 on the slide 277 which then transmits the rotation of the close spring release platform to rotation of the close spring release lever 267 as shown in FIG. 19. This rotates the close D latch pin 239 to release the close prop latch assembly 225 allowing the close prop 223 to be withdrawn resulting in release of the close spring 18 and closing the contacts 43. The close spring release platform 263 can also be rotated by the close push button 23 as will be described.

Adjacent to the projection on the slide 277, is a recess 287. Continued downward rotation of the close spring release platform 263 causes the finger 283 to slide off of the projection 281 on the slide and drop into the recess 287. This allows the close spring release levers 267, and therefore the close D latch pin 239, to return to the latching position and results in the condition shown in FIG. 20. At this point the close spring 18 can be recharged. If it were not for the interlock mechanism 265 of the invention, the continued actuation of the close solenoid 285 or the close push 23 would result in a "fire through" or rerelease of the close spring. The condition shown in FIG. 20 prevents that from happening and thus provides an "anti-pumping" feature. As the finger 283 starts to slide off of the projection 281 and enter the recess 287, it pulls the slide 277 toward the right to reach the position shown in FIG. 20. It is important that this condition not occur until the close spring release lever 267 has rotated sufficiently to release the close prop latch assembly 25 through rotation of the close D latch pin 239. This is assured by sizing the finger 283 so that the edge of the finger does not pass beyond the edge of the projection 281 defining the recess 287 thereby producing a component tending to pull the slide 277 to the right until the close D latch pin has rotated to release the close prop latch assembly 25.

By moving the slide 277 to the right as shown in FIG. 21 to a second position, the finger 283 on the close spring release platform 263 no longer engages the projection 281 on the slide but moves freely in the recess 287 so that the close spring release lever is not rotated with the close spring release platform and hence the close spring 18 is not released. The slide 277 is biased by a spring 289 to the first position shown in FIG. 18 in which actuation of the close spring release platform 263 rotates the close spring release lever 267. The slide 277 is moved to the second position by a contacts closed member in the form of a lobe 291 on the pole shaft 33 which rotates to engage the end of the slide 277 and move it to the second position in which the close spring release is overridden when the contacts 43 are closed. The slide 277 is also moved to the second, override position by a projection 293 on the trip member or platform 259 which normally projects into a notch 295 in the top of the slide 277. However, if the trip D latch pin 213 is actuated so that the trip platform 259 is rotated clockwise, the projection 293 engages the slide 277 at the end of the notch 295 and moves it to the second position shown in FIG. 21. Thus, if the trip mechanism 203 is actuated the close spring assembly 225 latch cannot be actuated.

It should be noted that neither the trip mechanism 203 nor the close spring latch assembly 225 requires any adjustment. The holes in the side plates 97 in which latch pins 213 and 239 are received provides sufficient alignment that good latch engagement is ensured. It should also be noted that no bearings are used with any of the latches and their associated parts. The punched holes in the side plates 97 provide all the bearing requirements because of the relatively light loads and low speeds of these parts. In addition, the interlock mechanism requires no lubrication as the parts are made of a very lubriscious molded plastic.

Figure 22:
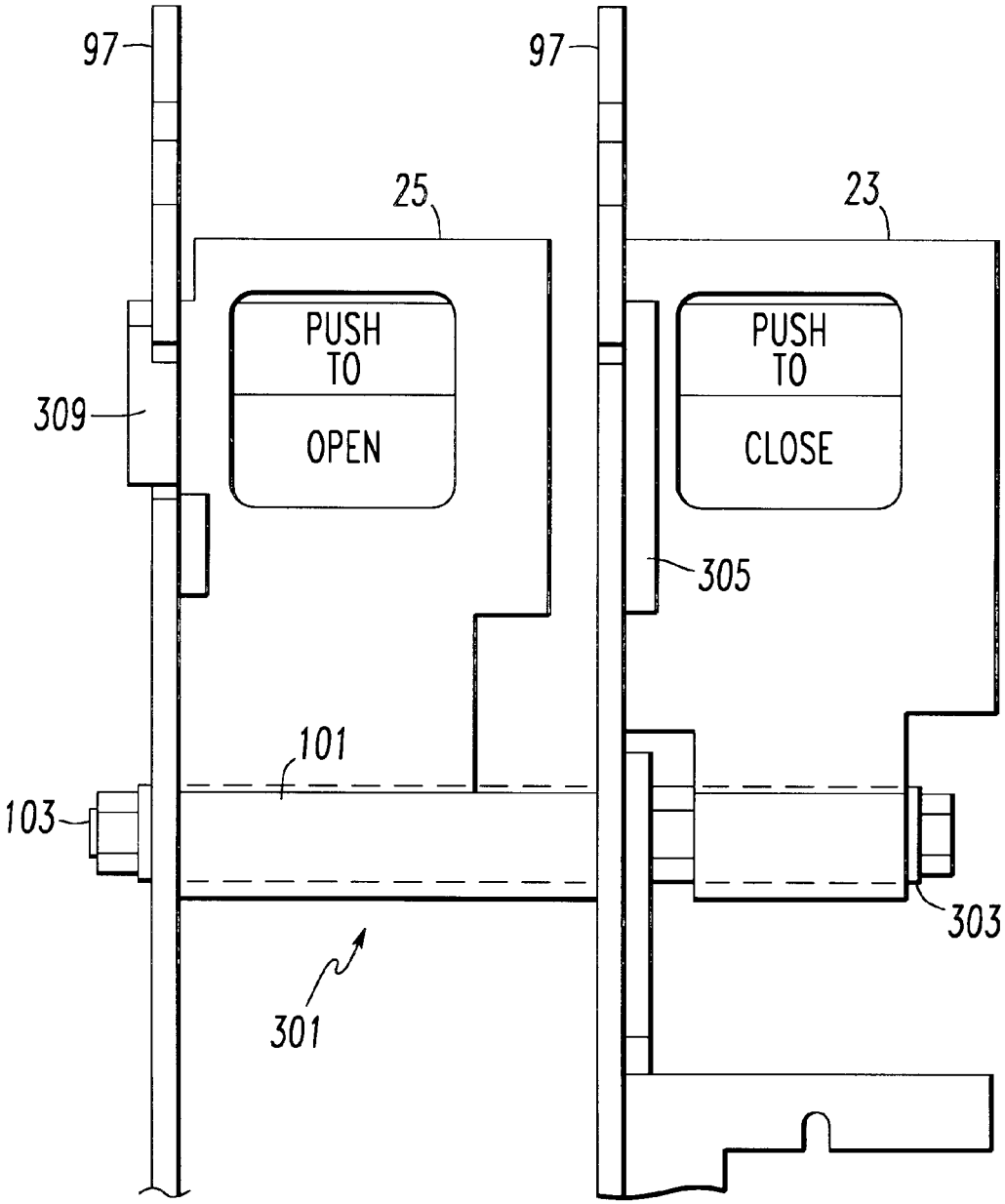
FIG. 22 is a front elevation showing the mounting of the push buttons on the operating mechanism.
Figure 23:
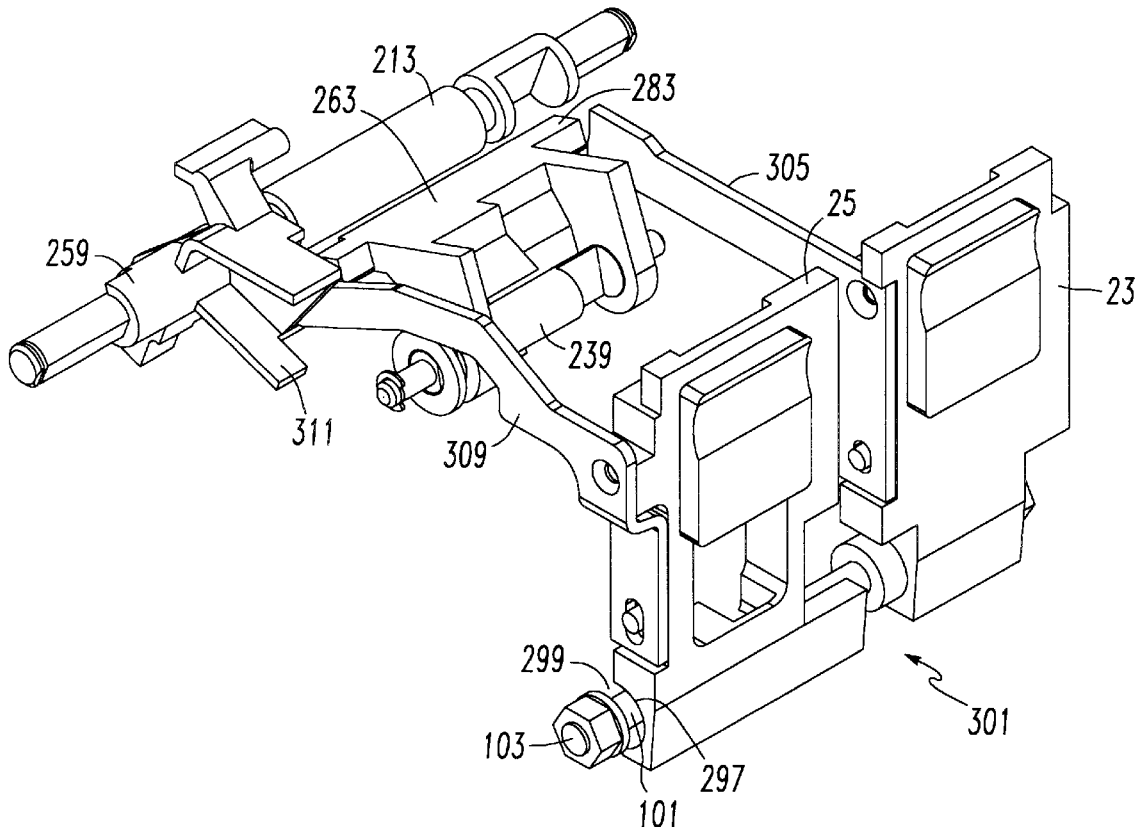
FIG. 23 is an isometric view illustrating the coupling of the push buttons to the latch assembly.

As mentioned, a push to close button 23 and a push to open button 25 are provided for closing and opening the contacts 43 of the circuit breaker, respectively. These buttons are mounted directly on and are part of the modular operating mechanism 17. As can be seen from FIGS. 22–24 and 26, the push buttons 23 and 25 are molded, generally planar members having a transverse bore 297 at the lower end which is opened along a side edge 299 less than 180° and preferably about 160°. These two molded push buttons 23 and 25 are pivotally mounted on a common pivot member 301 which extends through the side plates 97. The portion of the common pivot member 301 between the side plates 97 is formed by one of the spacers 101 fixing the spacing between the side plates as previously discussed. The threaded shaft 103 extends beyond the right hand side plate 97 of FIG. 22 and supports a sleeve 303 which forms a cylindrical member of the same diameter as the spacer 101. The push to close button 23 snaps onto the sleeve 303 as shown in FIG. 26 while the push to open button 25 snaps onto the spacer 101. An operating finger 305 secured to the top of the push to close button 23 extends alongside the right hand side plate 97 transverse to the common pivot where it engages the finger 283 on the close spring release platform 263 to release the close spring when pushed to the actuated position. This push to close button 23 is biased to the unactuated position by a torsion spring 307 (see FIG. 26) and the spring 231 biasing the spring release platform 263 (see FIG. 4). Similarly, the push to open button 25 has an operating finger 309 extending alongside the left hand side plate 97 in FIG. 22, again transverse to the pivot axis, and engaging a tab 311 on the trip platform 259 to open the contacts when actuated. The push to open button 25 is biased to the unactuated position by a torsion spring (not shown) similar to the spring 307.

As previously discussed, mounting of the push buttons on the operating mechanism 17 can make it difficult to align the push buttons with openings in the housing. The present invention avoids this difficulty by providing a face plate 19 through which the open and close push buttons 23 and 25 are accessible. The face plate 19 is also fixed to the operating mechanism, in a manner to be discussed, and therefore presents no alignment problems for the push button relative to the face plate. The face plate 19 is aligned behind the opening 21 in the cover 9 which forms part of the housing 3 for the circuit breaker (see FIG. 1). The face plate 19 is larger in area than the opening 21 so that taking into account the tolerances of the various components, the opening 21 is always filled by the face plate 19 when the cover is placed over the operating mechanism.

Figure 24:
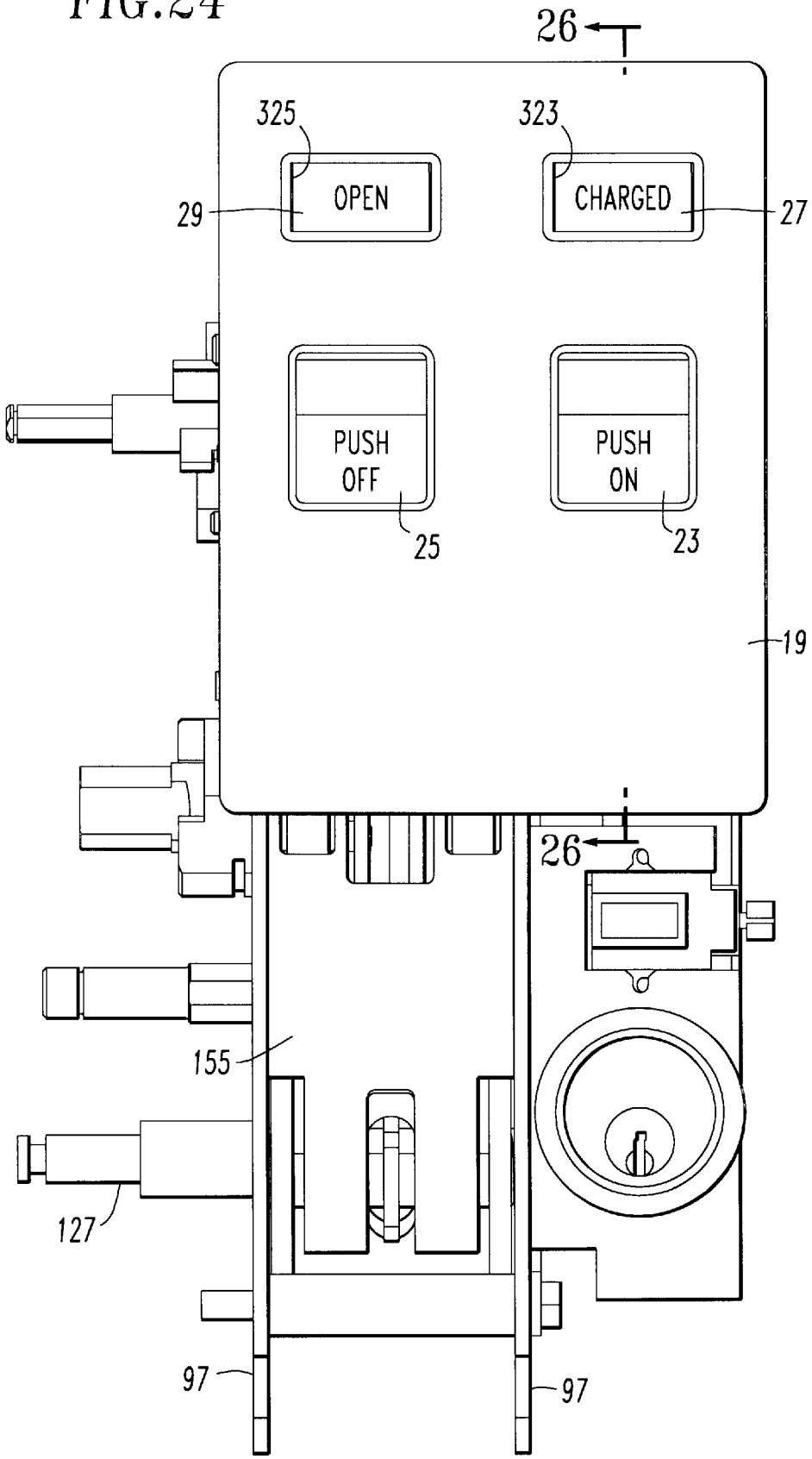
FIG. 24 is a front elevation view of the operating mechanism illustrating the face plate and the mounting of the push buttons and indicator flags.

Another unique feature of the invention is the manner in which the face plate 19 is mounted in a fixed position on the front of the operating mechanism 17. Referring also to FIGS. 24 and 25, it can be seen that the face plate 19 is a molded planar member with pairs of integral upper and lower mounting flanges 315*t* and 315*b*, respectively. The face plate is secured to the side plates 97 by mounting rods 317 which extend through the flanges 315 and the side plates 97. The lower flanges 315*b* are laterally spaced so that they abut the side plates 97 and therefore laterally fix the position of the face plate 19. The molded projection 319 extending rearward from about the center of the face plate 19 engages a notch 321 in the front edge of the one side plate 97 to vertically fix the position of the face plate.

This invention also overcomes the problems usually associated with aligning the close spring charge/discharge indicator 27 and the contacts open/closed indicator 29 with openings in the housing. In accordance with the invention, the indicators 27 and 29 are directly mounted in openings 323 and 325 in the face plate 19 as illustrated in FIGS. 24–27. As shown in FIG. 27, the molded indicators such as the charged/discharged indicator 27 are molded with an arcuate front face 327. The first and second charged and discharged states of the charge spring are indicated by the legend DISCHARGED and the symbol of a relaxed spring in the lower half of the arcuate face 327, and the legend CHARGED and the compressed spring symbol in the upper half. The separable contact state is provided by the legends OPEN and CLOSED on the arcuate face of the indicator 29.

The indicators 27 and 29 are pivotally mounted in the openings 323 and 325 in the face plate 19 by integral flanges 329 molded on the back of the face plate alongside the openings and having confronting pivot pins 331. The indicators are pivotally supported on the pins 331 by supports in the form of integral rearwardly extending flanges 333 having apertures 335 into which the pins 331 snap to pivotally capture the indicators.

The indicators 27 and 29 are rotated between their respective indications by "snap action" actuators 337 and 339. By "snap action" it is meant that the indicators 27 and 29 have discrete positions indicating the two states of the close spring and the contacts. They do not slowly change from one indication to the other, but by discrete movement jump from one to the other.

Figure 28:
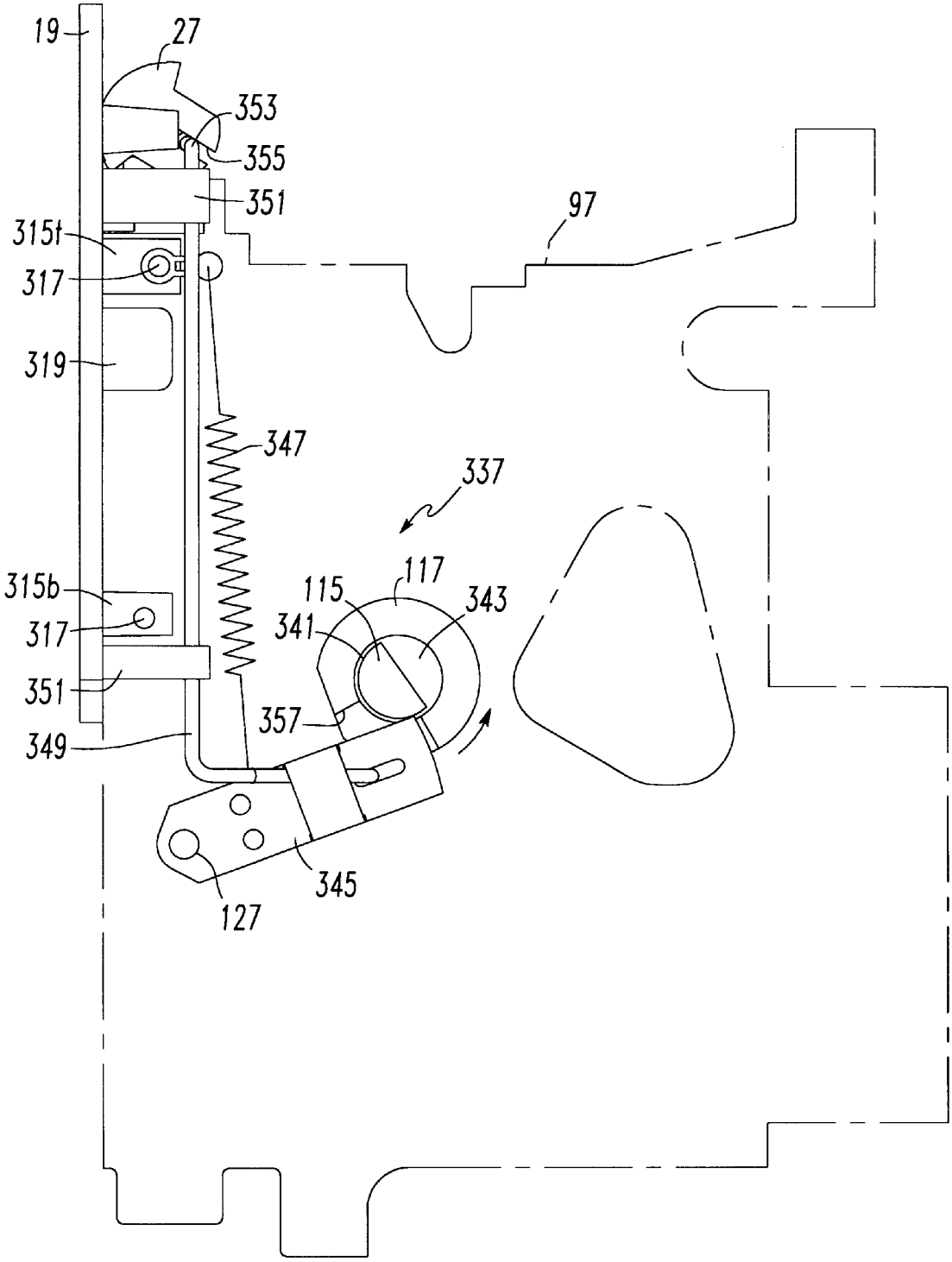
FIG. 28 is a side elevation view of the operating mechanism illustrating the snap action of the close spring state indicator in the discharged state of the spring.
Figure 29:
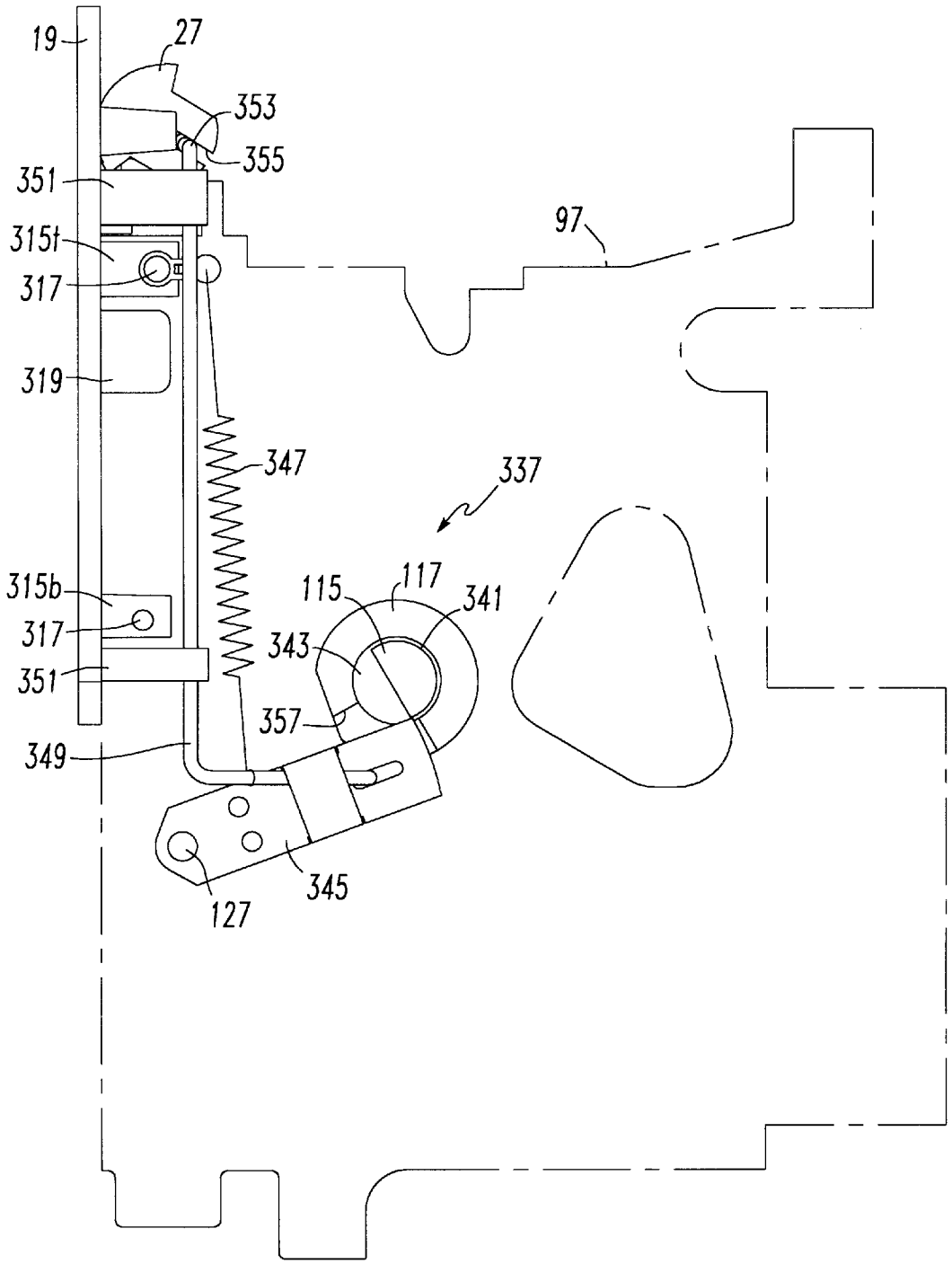
FIG. 29 is a view similar to FIG. 28 illustrating the state of the close spring indicator flag just before the spring becomes fully charged.
Figure 30:
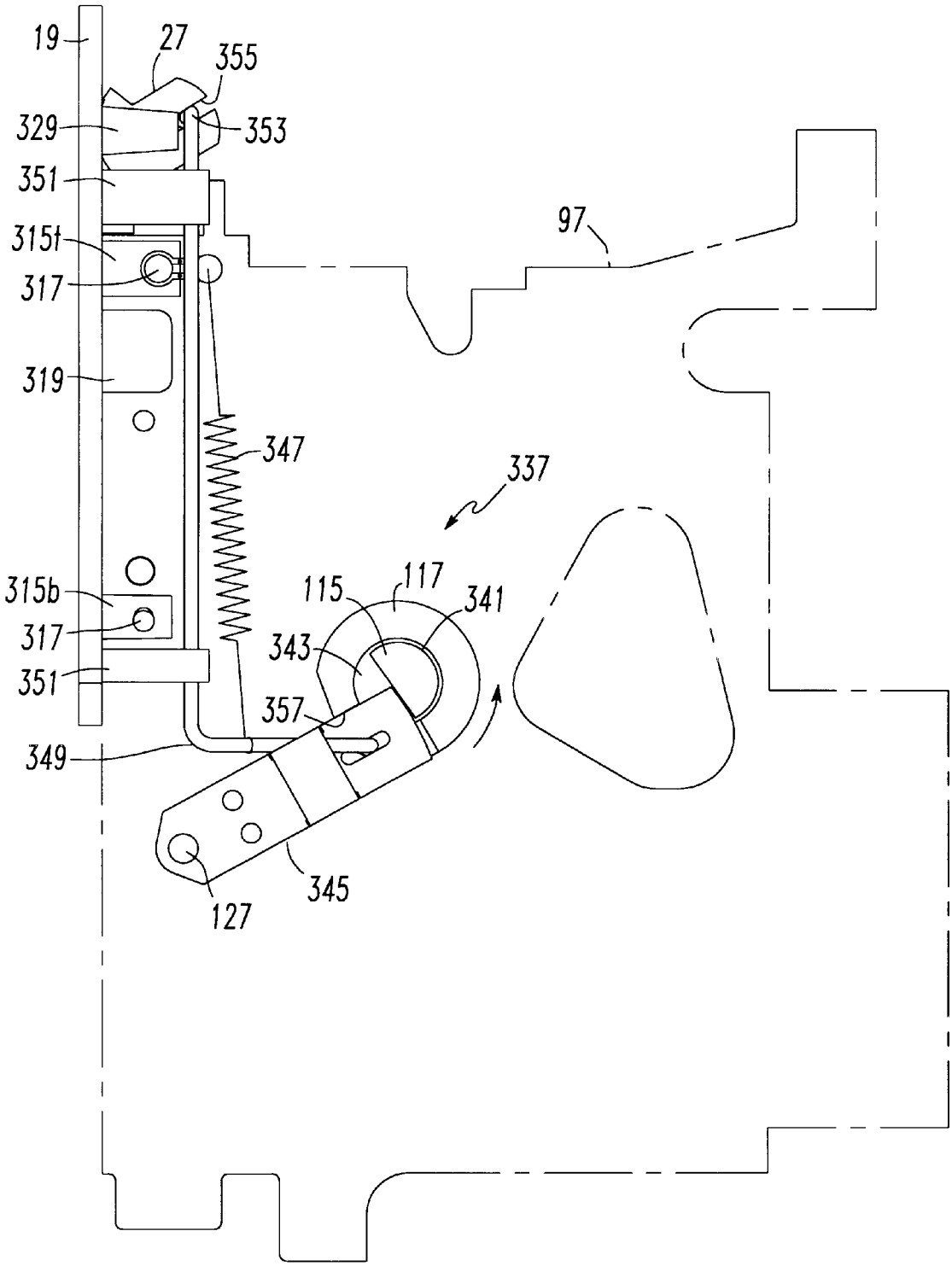
FIG. 30 is a view similar to FIG. 28 showing the close spring indicator flag in the charged state.

The "snap action" actuator 337 for the close spring indicator 27 includes the cam shaft 115. As previously described, the cam member 171 which is mounted on the cam shaft 115 charges the close spring 18 through half of its rotation and delivers energy stored in the spring to close the contacts 43 during another portion of rotation. Thus, the rotational position of the cam shaft 115 to which the cam member 171 is fixed provides a positive and reliable indication of the charge state of the spring 18. As shown in FIGS. 28–30, the outer end of the cam shaft 115 which projects beyond the side plate 97 has a cylindrical peripheral surface 341 with a radial discontinuity provided by a recess 343 formed by a flat on the cam shaft 115. In order to couple the rotational position of the cam shaft 115 to the charged/discharged flag or indicator 27, a drive member in the form of a lever 345 pivoted at one end on the rocker pin 127 is biased toward the cam shaft 115 by a tension spring 347. As can be seen from FIG. 28, the second end of the drive lever 345 bears against the cylindrical peripheral surface 341 of the cam shaft 115 when the close spring 18 is fully discharged. A wireform 349 engaged at one end by the drive member is mounted for vertical movement by a pair guides 351 molded on the rear of the face plate 19 (see also FIG. 25). A finger 353 on the upper end of the wireform 349 engages a notch 355 in the indicator flange 333 rearward of the pivot for the indicator 27. The DISCHARGED legend is displayed with the close spring fully discharged.

As the close spring 18 is charged through rotation of the cam member 115, the cam shaft rotates counterclockwise as shown by the arrow in FIG. 28. The drive lever 345 stays at rest against the cylindrical peripheral surface 341 on the cam shaft 115 as the cam shaft rotates about 175° degrees to the position shown in FIG. 29. As discussed above, the charge cam 173 reached a peak at 170 degrees and is now being driven by the charge spring. As shown in FIG. 29, the drive lever 345 is right on the edge of the recess 343 in the cam shaft 115. As the spring 18 rotates the cam to the closed position shown in FIG. 30, the second end of the drive lever 345 drops off of the cylindrical surface 341 on the cam shaft 115 and into the recess 343. This snaps the flag indicator 27 by discrete movement to the charged position with the CHARGED legend appearing in the window 323. The drive lever 345 is retained in the recess 343 by a stop 357 formed by a notch in the collar of the cam shaft bushing 117.

The close spring is released such as by pressing of the close button 29 or actuation of a close solenoid. The sudden release of the energy stored in the close springs 87 (see FIG. 2) rapidly rotates the cam shaft 115 in the direction of the arrow shown in FIG. 30 to the fully discharged position shown back in FIG. 28. It can be appreciated from FIG. 30 that the flat on the cam shaft 115 pushes the drive lever 345 down until the second end engages the cylindrical peripheral surface 341 again as shown in FIG. 28.

Figure 31:
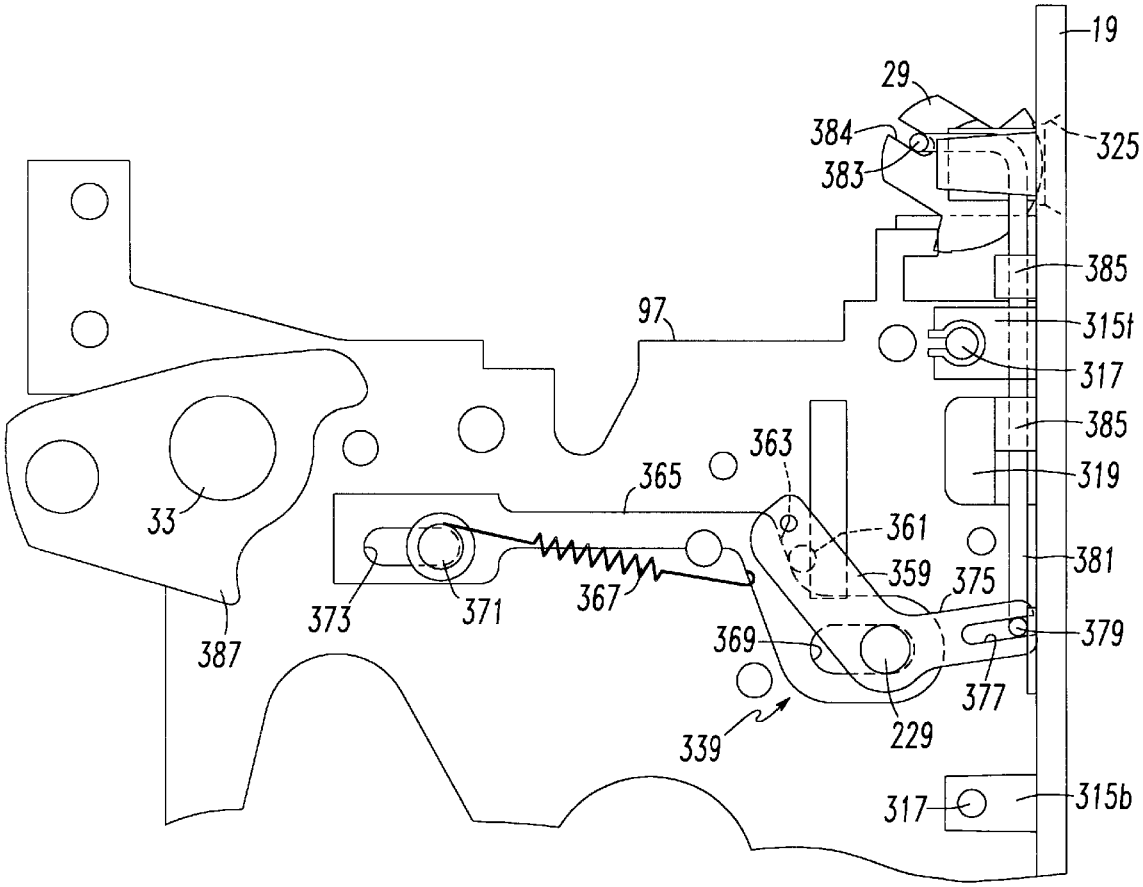
FIG. 31 is a side elevation view of the contact state indicator flag operating mechanism when the main circuit breaker contacts are closed.
Figure 32:
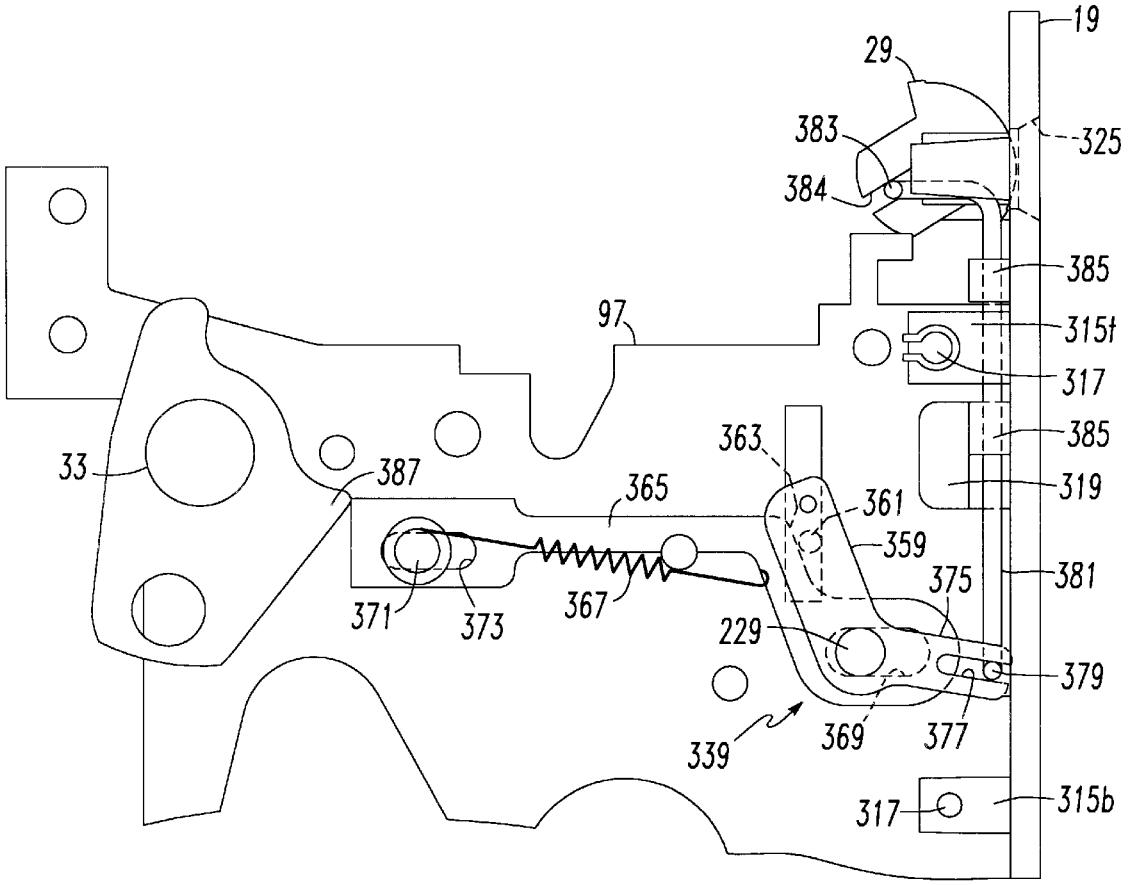
FIG. 32 is similar to FIG. 31 showing the open/closed indicator flag operating mechanism when the main circuit breaker contacts are open.

The open/closed indicator flag 29 which provides an indication of the state of the contacts 43 is driven by the pole shaft 33 which provides a positive indication of the contact state. As shown in FIGS. 31 and 32 the snap actuator 339 for the indicator 29 includes a generally L shaped open/closed driver 359 which is pivotally mounted on the close prop pivot pin 229. A pin 361 mounted on one arm of the open/closed driver 359 is biased against a shoulder 363 on an open/closed slider 365 by a tension spring 367. The open/closed slider 365 is an elongated member which is slidably mounted on the close prop pivot pin 229 by a slot 369 at one end and on a pin 371 at the other end by an elongated slot 373. A second arm 375 on the open/closed driver 359 has a slot 377 which is engaged by the bent lower end 379 on the wireform 381. The upper end 383 of the wireform 381 is bent laterally to engage the notch 384 in the indicator 29. The wireform 381 is supported intermediate the ends by molded guides 385 on the back of the face plate 19. The open/closed slider 365, the open/closed driver 359 and the wireform 381 comprise an actuating linkage connected to the open/closed indicator 29.

With the contacts 43 closed, the snap actuator 339 for the open/closed indicator 29 is biased by spring 367 to the position shown in FIG. 31 in which the open/closed indicator flag 29 is rotated downward to display the legend CLOSED in the window 325. When the contacts 43 are opened, the pole shaft 33 is rotated to the position shown in FIG. 32 wherein the pole shaft lobe 387 engages the open/closed slider 365 and drives it to the right. This rotates the open/closed driver 359 clockwise which in turn pulls the wireform 381 downward to rotate the open/closed indicator flag 29 counterclockwise to display the OPEN legend in the window 325. The pole shaft 33 is rapidly rotated by the close spring 18 from the open position shown in FIG. 32 to that shown in FIG. 31 to close the contacts. This rapid action causes the open/closed indicator flag 29 to snap from displaying the OPEN legend to indicating the CLOSED state of the contacts under the influence of the spring 367. Likewise, the pole shaft 33 rotates rapidly to the position shown in FIG. 32 when the contacts are driven open by the springs 87. It should be noted that the open/closed indicator is biased to the "closed" position and only snaps to the open position during the very last part of pole shaft rotation. Thus, if the contacts are welded shut, the indicator will continue to display the unsafe "closed" indication.

As previously discussed, the close spring 18 can be charged manually or electrically through rotation of the cam shaft 115. The drive mechanism 387 for manually or electrically rotating the cam shaft 115 is shown in FIGS. 33–37. This drive mechanism 387 includes a pair of ratchet wheels 389*a* and 399*b* keyed to flats on the cam shaft 115. Also keyed to the cam shaft between the ratchet wheels 389 are a handle decoupling cam 391 and a motor decoupling cam 393. Pins 395 couple the cams 391 and 393 to the ratchet wheels 389 so that torque is transmitted from the ratchet wheels into the cam shaft 115 through the cams 391 and 393 as well as through the ratchet wheels directly.

The ratchet wheels 389 are rotated by the charge handle 31 through a handle drive link 397 made up of two links 397*a* and 397*b* with the link 397*b* only having a cam surface 399 near the free end. This free end of the handle drive link 397 extends between the pair of ratchet wheels 389 and has a handle drive pin 401 which can engage peripheral ratchet teeth 403 in the ratchet wheels. The other end of the handle drive link 397 is pivotally connected to the handle 31 by a pivot pin 405.

The handle 31 is pivotally mounted on an extension of the rocker pin 127 and is retained by a C-clamp 407. A stop dog 409 made up of a pair of plates 409*a* and 409*b* is also pivoted on the rocker pin 127. This stop dog 409 also extends between the ratchet plates 389*a* and 389*b* and has a transverse stop pin 411 which engages the ratchet teeth 403. A tension spring 413 (see FIG. 36) biases the handle drive link 397 and the stop dog 409 toward each other and toward engagement with the ratchet wheels 389. In addition, a torsion spring 415 is mounted on the rocker pin 127 and has one leg 415*a* which bears against the underside of the handle and biases it toward a stowed position such as shown in FIG. 33 and a second arm 415*b* which bears against the underside of the stop dog and also biases it toward the ratchet wheels 389.

Another unique feature of the invention is the configuration of the ratchet teeth 403 and the drive pin 401 and stop pin 411. As shown in the fragmentary view of FIG. 35, the ratchet teeth 403 are of an arcuate configuration and have roots 403*r* having a radius which is complementary to the radii of the handle drive pin 401 and the stop pin 411. This configuration reduces stress concentration at the roots of the ratchet teeth 403 and also makes it easier to manufacture the ratchet wheels 389 in that they can be easily stamped from flat stock material. The use of turned pins for the handle drive pin 401 and the stop pin 411 also eliminate the stress concentrations created by having the usual straight edged drive and stop teeth.

Figure 33:
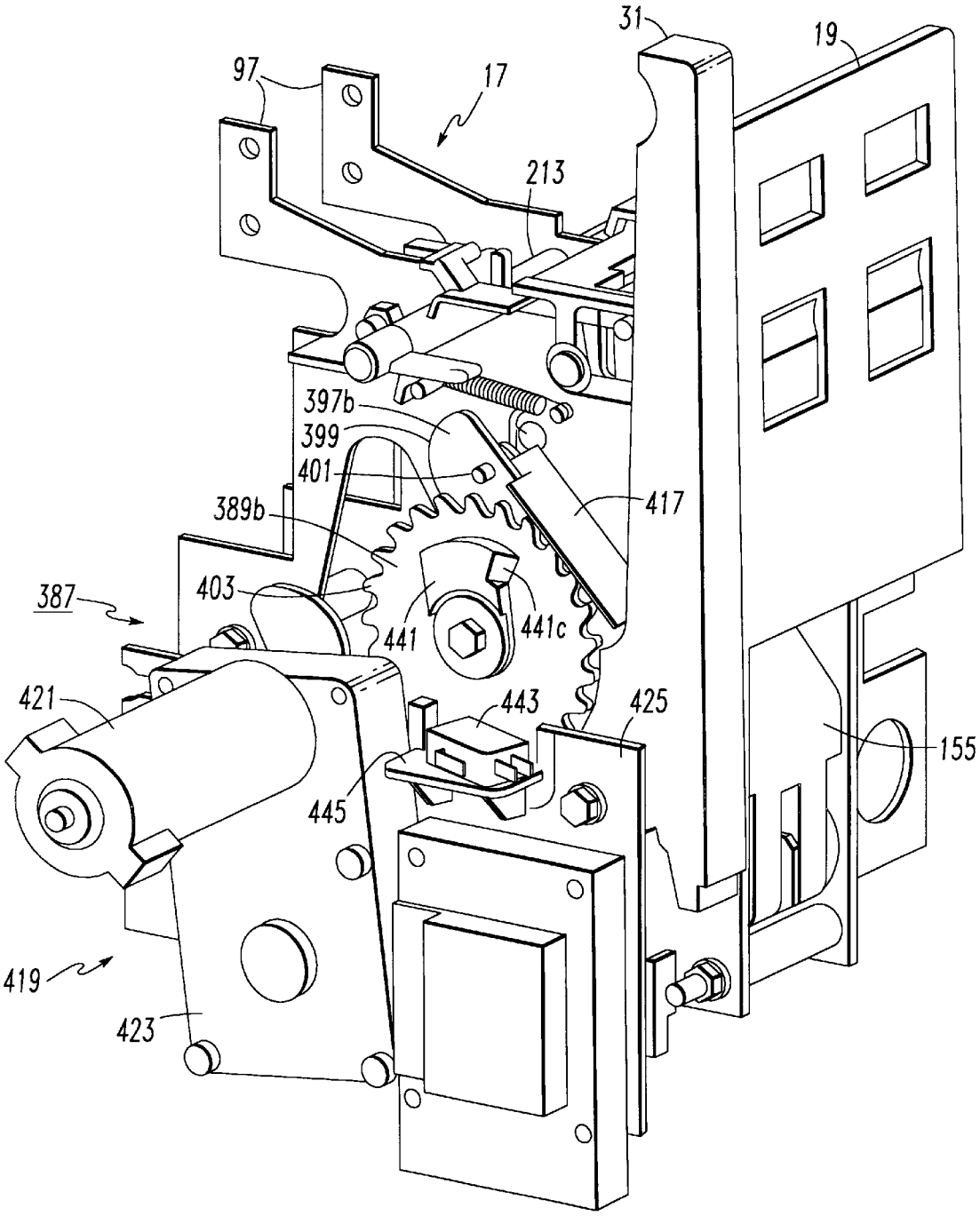
FIG. 33 is an isometric view of the assembled operating mechanism particularly illustrating the manual and electric charging system.
Figure 34:
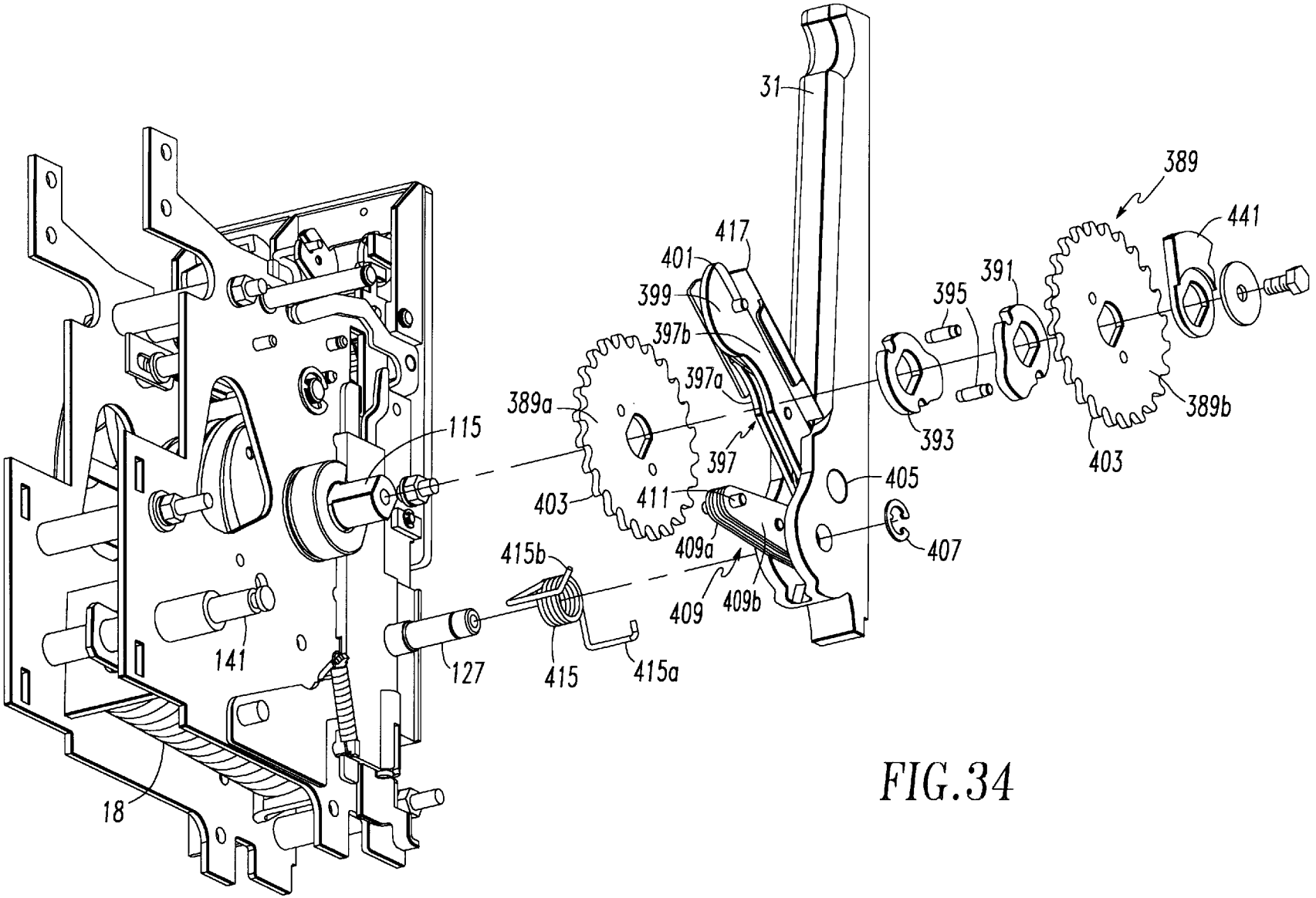
FIG. 34 is an exploded isometric view of the manual charging mechanism for the close spring.
Figure 35:
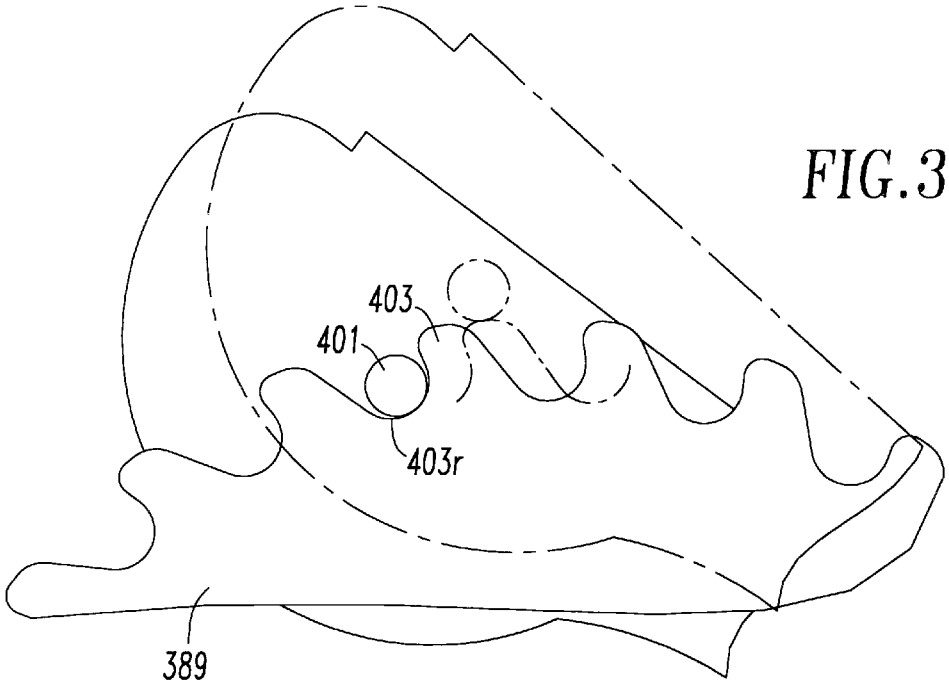
FIG. 35 is an elevation view of an enlarged scale of a section of a ratchet wheel which forms part of the spring charging mechanism.
Figure 36:
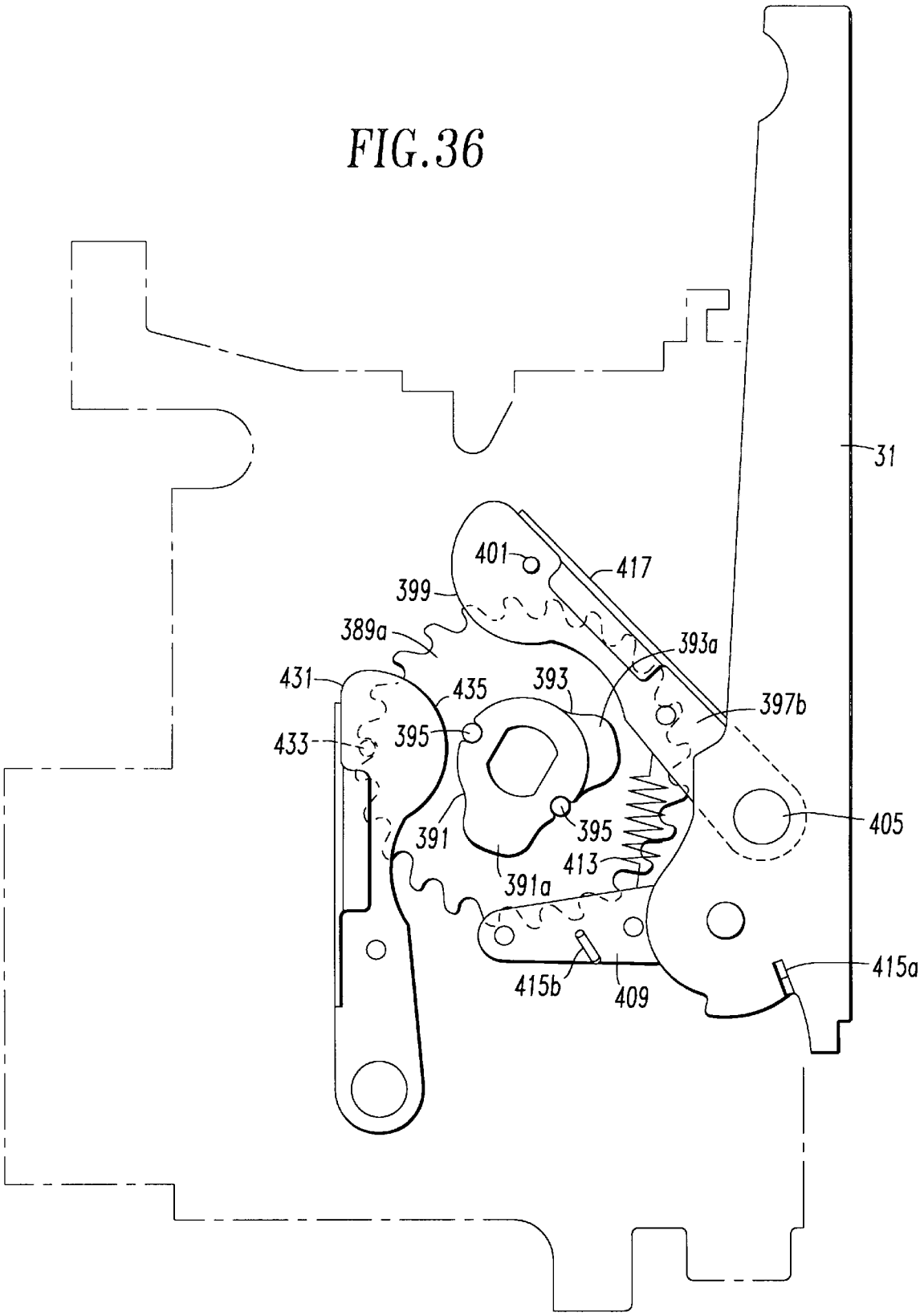
FIG. 36 is a side elevation view of the operating mechanism showing the close spring charging mechanism assembled and with a portion of the motor charging unit removed for clarity.

The close spring 18 is manually charged by pulling the handle 31 downward in a clockwise direction as viewed in FIGS. 33, 34 and 36. As the handle is pulled downward, the handle drive pin 401 engages a tooth 403 in each of the ratchet wheels 389*a* and 389*b* to rotate the cam shaft 115 clockwise. The springs 413 and 415 allow the stop dog to pass over the clockwise rotating ratchet teeth 403. At the end of the handle stroke, the torsion spring 415 returns the handle 31 toward the stowed position. Again, the spring 413 allows the handle drive pin to pass over the teeth which are held stationary by the stop dog 409. As the handle 31 is mounted on the rocker pin 127 instead of the cam shaft 115 so that it rotates about an axis which is parallel to but laterally spaced from the axis of the ratchet wheels, the drive link 397 can be connected by the pin 405 to the handle 31 at a point which is closer to the axis provided by the rocker pin 127 than the radii of the ratchet wheels 389*a* and 389*b*. This arrangement provides a greater mechanical advantage for the handle 31 which of course is significantly longer than the radii of the ratchet wheels 389*a* and 389*b*.

Figure 14:
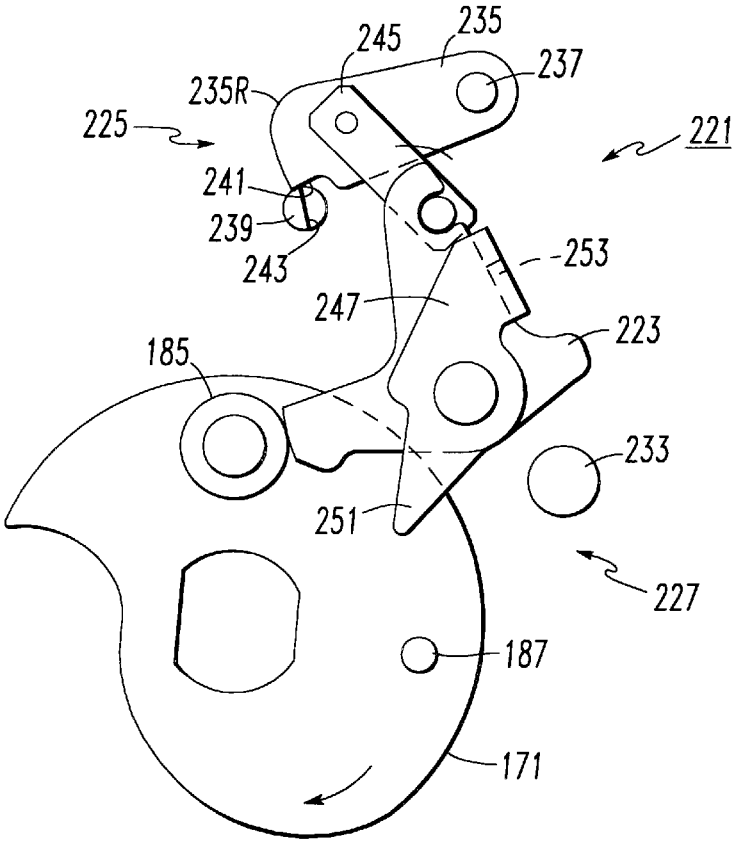
FIG. 14 is a view similar to FIG. 12 showing the close prop holding the spring in the charged state.
Figure 15:
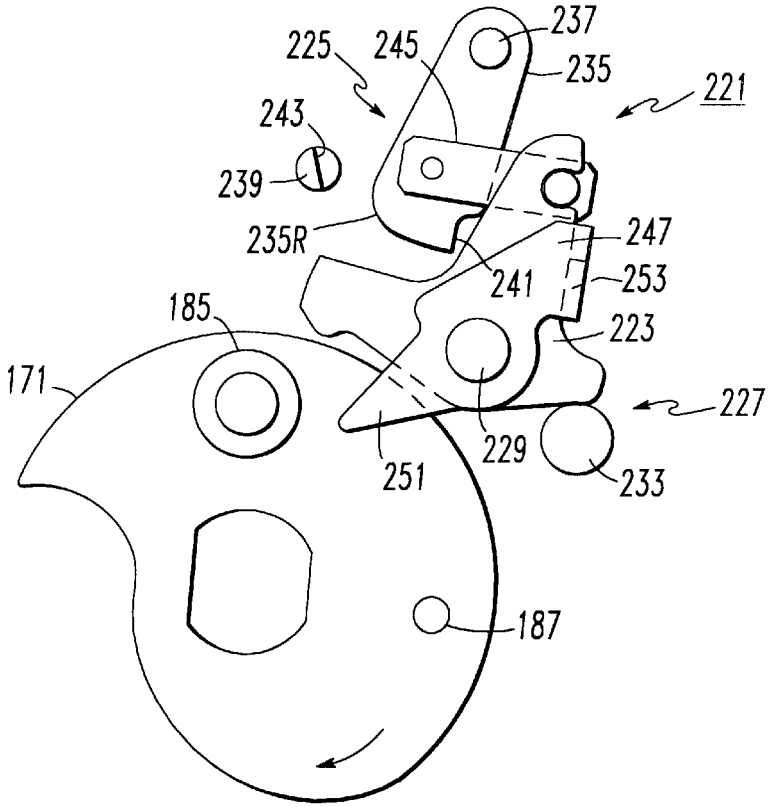
FIG. 15 is a view similar to FIG. 12 illustrating the close prop immediately after it has been released to close the contacts.

The handle 31 is repetitively reciprocated to incrementally rotate the ratchet wheels 389 and therefore the cam shaft 115 to charge the spring 18. As the spring 18 becomes fully charged, the handle decoupling cam 391 rotates to a position where the cam lobe 391*a* engages the cam surface 399 on the handle drive link plate 397*b* and lifts the drive link 397 upward so that the handle drive pin 401 is disengaged from the ratchet teeth 403 of the ratchet wheels 389. Thus, once the close spring 18 has been charged and the close prop 223 is sitting against the cam member 171 (as shown in FIG. 14), the handle 31 is disconnected so that force can no longer be applied to attempt to rotate the cam shaft 115 against the close prop 223.

When the close spring 18 is released, the cam shaft 115 rotates rapidly. It has been found that as this occurs the bouncing of the handle drive pin 401 by the rapidly turning ratchet teeth 403 causes the handle 31 to pop out of the stowed position. This is prevented by an arrangement through which the drive pin 401 is disengaged from the ratchet teeth 403 with the handle in the stowed position. In one embodiment, a lateral projection in the form of a cover plate 417 on the tops of the handle drive link 397 performs this function. This cover plate 417 rides on the tops of the ratchet teeth 403 with the handle in the stowed position thereby lifting the handle drive pin 401 clear of the ratchet teeth 403 as illustrated in FIG. 33. This does not interfere with the normal operation of the handle 31, because as the handle is pulled downward the cover plate 417 slides along the teeth until the handle drive pin 401 drops down into engagement with a tooth 463 on each of the ratchet wheels 389. Preferably, the cover plate 417 is molded of a resilient resin material.

Figure 37:
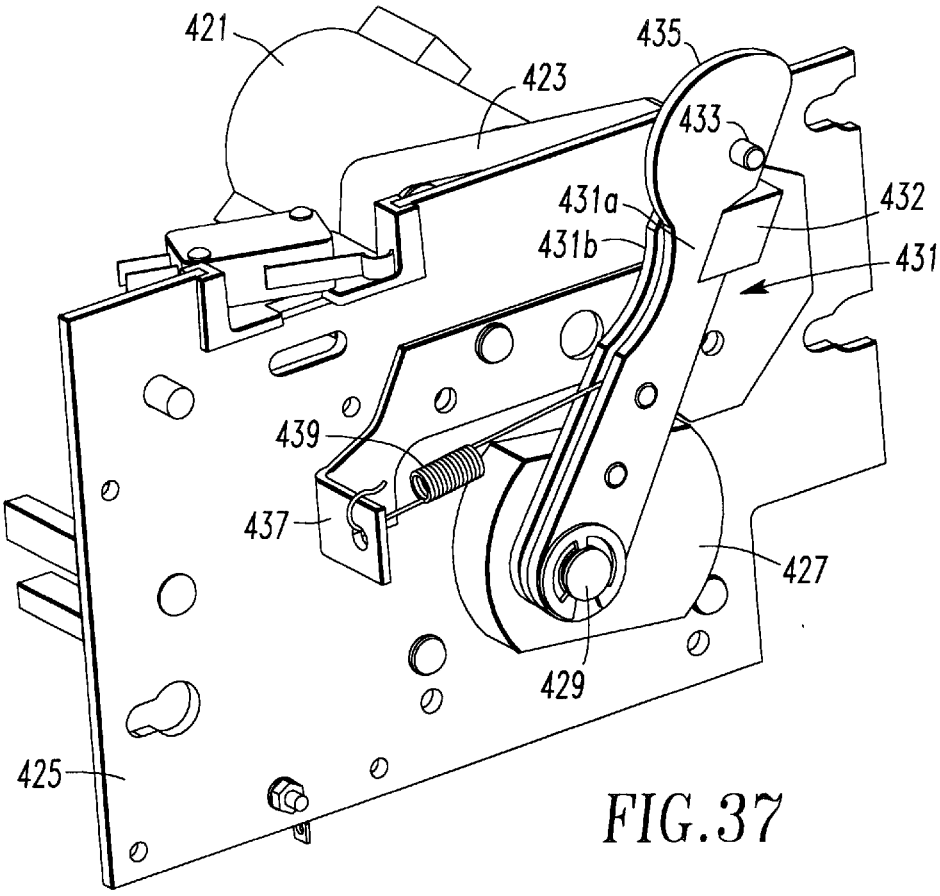
FIG. 37 is an isometric view of the motor operator for electrically charging the close spring.

The drive mechanism 387 also includes a motor operator 419 which includes a small high torque electric motor 421 with a gear reduction box 423. A mounting plate 425 attaches the optional motor operator 419 to the side of the operating mechanism 17 at support points which include the spring support pin 141. As can be seen in FIGS. 36 and 37, the output shaft (not shown) of the gear box has an eccentric 427 to which is mounted by the pivot pin 429 a motor drive link 431. The drive link 431 is fabricated from two plates 431*a* and 431*b* which support adjacent a free end a transverse, turned motor drive pin 433. The motor drive link 431*a* has a cam surface 435 adjacent the motor drive pin 433. A bracket 437 supports a tension spring 439 which biases the motor drive link 431 counterclockwise as viewed in FIG. 37. A V-shaped plastic stop 432 supported by a flange on the bracket 437 centers the motor drive link 431 for proper alignment for engaging the ratchet wheel 389. As can be appreciated from FIG. 36, with the motor operator 419 mounted on the side of the operating mechanism 17, the spring 439 biases the motor drive pin 433 into engagement with the ratchet teeth 403 of the ratchet wheels 389. Operation of the motor 421 rotates the eccentric 427 which reciprocates the motor drive link 431 for repetitive incremental rotation of the ratchet wheels 389. When the close spring 18 becomes fully charged, the motor decoupling cam 393 rotates to a position (not shown) where the lobe 393*a* engages the cam surface 435 on the motor drive link 413*a* and lifts the motor drive link 431 away from the ratchet wheel 389 so that the motor drive pin 433 is disengaged from the ratchet teeth 403. Again, this prevents continued application of torque to the cam shaft which is being restrained from rotation by the close prop 223. At the same time, a motor shut off cam 441 (see FIG. 33) mounted on the end of the cam shaft 115 outside of the ratchet wheels 389 rotates to a position where it engages a motor cutoff microswitch 443 mounted on a platform 445 secured to the mounting plate 425. The axially extending cam surface 441*c* actuates the switch 443 to turn off the motor 421.

Figure 38:
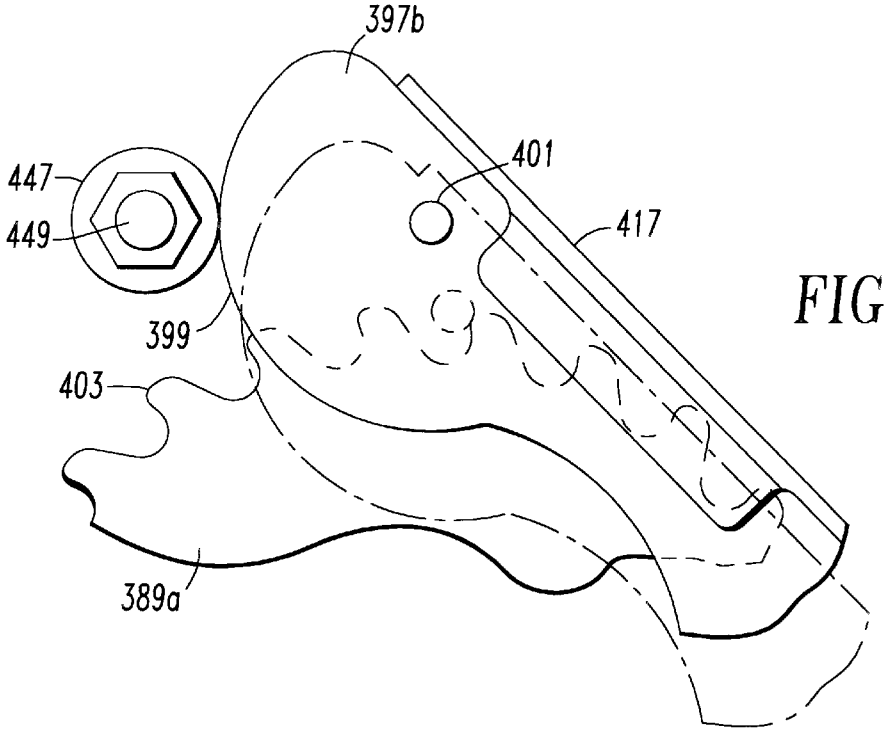
FIG. 38 is a fragmentary elevation view illustrating an alternative embodiment of the charging mechanism.

An alternative arrangement for disengaging the handle drive pin 401 from the ratchet teeth 403 and the ratchet wheels 389 is illustrated in FIG. 38. In this embodiment, a lifting member or stop in the form of, for example, a sleeve 447 is fixed to the side plate 97 adjacent the ratchet wheel 389 by a bolt 449. As the handle 31 is returned to the stowed position, shown in full line in FIG. 38, the cam surface 399 on the drive link 397*b* engages the lift member 447 and rotates the drive link clockwise, as shown in the figure, to disengage the drive pin 401 from the ratchet teeth 403. Thus, when the close spring is released and the ratchet wheels rapidly rotate, the drive link is held clear of the ratchet wheel and the handle 31 is not disturbed. When the handle is pulled clockwise, it rotates about 15 degrees to the position shown in phantom in FIG. 38 in which the drive pin 401 reengages the ratchet teeth 403. Both this lifting member 447 and the cover plate 417 provide this about 15 degrees movement of the handle before a ratchet tooth is engaged. This allows the user to obtain a firm grip on the handle before the handle is loaded.

As previously discussed, the major components of the operating mechanism 17 are mounted between and supported by the side plates 97. This produces a modular operating mechanism which can be separately assembled. All of the components are standard, with only the close spring being different for the different current ratings. Thus, the operating mechanisms can be fully assembled and inventoried except for the close spring which is selected and installed for a specific application when identified.

This arrangement of mounting all of the components between or to the side plates, also eliminates the need for many fasteners, as the parts are captured between the side plates as discussed above. Also, for rotating shafts with light loads, separate bearings are not required as the fixed alignment of the side plates assures alignment of the shaft, and the openings in the side plates provides sufficient journaling. In this regard, the apertures for the shafts are punched which, as is known, produces a thin annular surface in the punched aperture thinner than the thickness of the plate which serves as a bearing.

Figure 39:
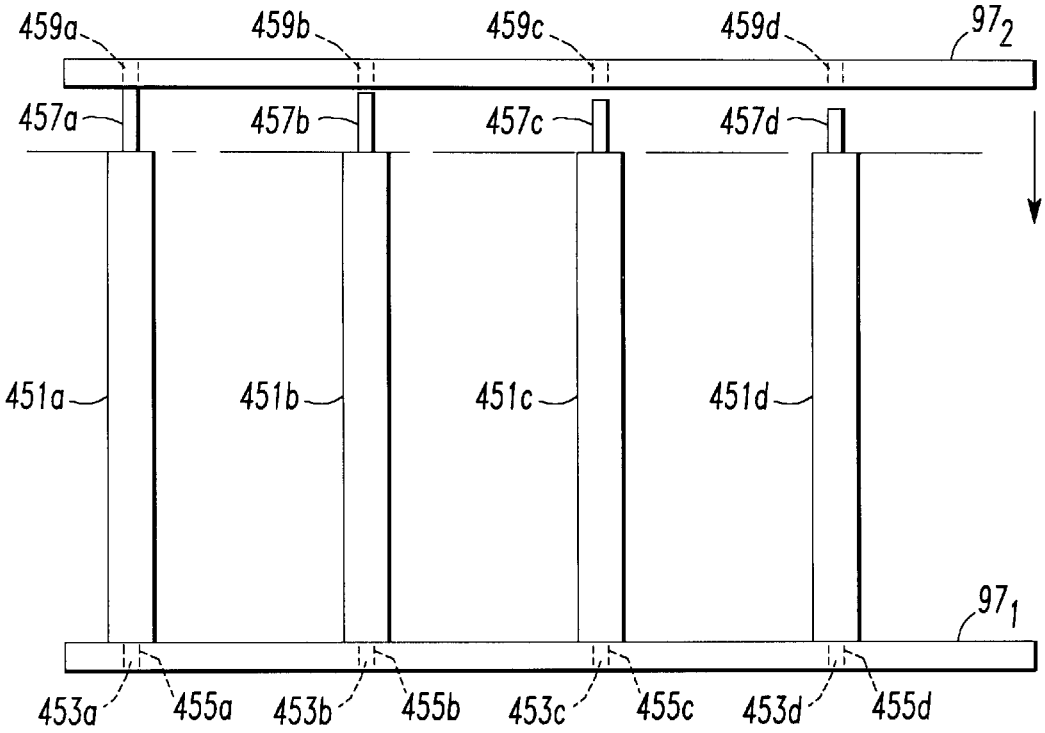
FIG. 39 is a schematic illustration of a feature which simplifies assembly of the operating mechanism.

This modular construction also simplifies assembly of the operating mechanism 17. As illustrated in FIG. 4, the operating mechanism can be built up on one of the side plates 97. With all of the parts installed, the other side plate is placed on top and is secured by the nuts 105 (see FIG. 3). To facilitate assembly, the various shafts, all of which have the same length for capture between the side plates, have varying lengths of reduced diameter ends which are received in apertures in the side plates. Thus, as shown schematically in FIG. 39, pins 451*a*–451*d* all have one reduced diameter end 453*a*–453*d* of the same length inserted in the apertures 455*a*–455*d* of one of the side plates $\mathbf{97}_1$. After all the other components (not shown in FIG. 40) have been installed, the second plate $\mathbf{97}_2$ is placed on top so that the second ends 457*a*–457*d* of the shafts 451*a*–451*d* can register with the apertures 459*a*–459*d*. So that all of the pins do not have to be inserted in the apertures in the upper plate $\mathbf{97}_2$ simultaneously, the reduced diameter end 457*a* is longer than the others and can be inserted in its associated aperture by itself first. As the plate $\mathbf{97}_2$ is lowered, the shorter end 457*b* of the pin 451*b* is inserted in its aperture 459*b*. Each shaft is likewise journaled in the plate $\mathbf{97}_2$ as the plate is successively lowered, but all of the pins do not have to be aligned simultaneously.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An interlock assembly for electrical switching apparatus for opening and closing an electric power circuit and having close spring means for closing the electric power circuit and open spring means for opening the electric power circuit, said interlock mechanism comprising:

a close spring release lever for releasing said close spring means to close said electric power circuit when rotated;

a close spring release platform which is rotated to initiate release of said close spring means; and an interlock mechanism between said close spring release lever and said close spring release platform and including an interlock member moveable between a first position in which said interlock member transmits rotation of said close spring release platform into rotation of said close spring release lever to release said close spring means and operate the electrical switching apparatus to close the electric power circuit, and a second position in which rotation of said close spring release platform is not transmitted into rotation of said close spring release lever and means biasing said interlock member to said first position.

2. The interlock assembly of claim 1 wherein said interlock mechanism includes means biasing said close spring release lever to a position in which said close spring means is not released.

3. The interlock assembly of claim 2 wherein said interlock mechanism further includes a contacts closed member moving said interlock member to said second position when said electrical switching apparatus is closed.

4. The interlock assembly of claim 2 wherein said interlock mechanism includes a trip member releasing said open spring means to open said electrical switching apparatus and having means moving said interlock member to said second position when said trip member is actuated.

5. The interlock assembly of claim 4 wherein said interlock mechanism includes a contacts closed member moving said interlock member to said second position when said electrical switching apparatus is closed.

6. The interlock assembly of claim 2 wherein said close spring release platform has a finger thereon which engages said interlock member when said closing spring release platform is rotated with said interlock member in said first position, said interlock member having a recess into which said finger on said close spring release platform rotates without rotating said interlock member with said interlock member in said second position.

7. The interlock assembly of claim 6 wherein said release lever is secured to a close latch pin which is rotated by said release lever to release the close spring, and said close spring release platform is pivoted on but rotates independently of said close latch pin.

8. The interlock assembly of claim 6 wherein with said interlock member in said first position continued rotation of said close spring release platform causes said finger to slide off of said interlock member and into said recess in said interlock member thereby pulling said interlock member toward said second position and preventing rerelease of said close spring means without release of said close spring release platform.

9. The interlock assembly of claim 8 wherein said finger is sized to delay its sliding into said recess and pulling said interlock member toward said second position until said close spring release lever has been rotated sufficiently to release said close spring means.

10. Electrical switching apparatus which is opened and closed to control power flow in an electric power circuit, said electrical switching apparatus comprising:

separable contacts including fixed contact means and moveable contact means;

a contact carrier on which said moveable contact means is mounted for movement to open and close said separable contact;

an operating mechanism for moving said contact carrier to open and close said separable contacts and including:

close spring means which is charged to store energy and released to discharge the stored energy to move said contact carrier to close said separable contacts;

open spring means which is charged by closing said separable contacts and is released to open said separable contacts; and an interlock assembly including:

a release lever for releasing said close spring means to release said stored energy and close said separable contacts when moved;

a close release platform moveable to initiate release of said close spring means;

an interlock member between said release lever and said close spring release platform and moveable between a first position in which said interlock member transmits movement of said close spring release platform to said release lever to release said close spring means, and a second position in which movement of said close spring release platform is not transmitted to said release lever; and a trip member moveable to a trip position to release said open spring means to open said separable contacts and to move said interlock member to said second position.

11. The electrical switching apparatus of claim 10 wherein said interlock assembly further includes a contact closed member moveable to a closed position when said separable contacts are closed and in which closed position said interlock member is engaged by said contact closed member and moved to said second position to prevent release of said close spring means.

12. The electrical switching apparatus of claim 10 wherein said interlock assembly includes first mounting means mounting said release lever for rotation to release said closing spring, and second mounting means mounting said close spring release platform for rotation, said interlock member transmitting rotation of said close spring release platform into rotation of said release lever when said interlock member is in said first position only.

13. The electrical switching apparatus of claim 12 wherein said interlock assembly includes third mounting means mounting said interlock member to slide between said first and second positions and permitting rotation of said interlock member in said first position to transmit rotation of said close spring release platform into rotation of said release lever.

14. The electrical switching apparatus of claim 13 wherein said close spring release platform has a finger thereon which engages said interlock member when said closing spring release platform is rotated with said interlock member in said first position, said interlock member having a recess into which said finger on said close spring release platform rotates without rotating said interlock member with said interlock member in said second position.

15. The electrical switching apparatus of claim 14 wherein said trip member comprises a latch pin rotatable to an unlatched position to release said open spring means, and a trip lever mounted on said latch pin and sliding said interlock member to said second position as said latch pin rotates to said unlatched position.

16. The electrical switching apparatus of claim 15 wherein said operating mechanism includes a push to close button and means rotating said close spring release platform when said push to close button is actuated, and a push to open button and means rotating said trip lever to rotate said latch pin to said unlatched position and move said interlock member to said second position when said open push button is actuated.

17. The electrical switching apparatus of claim 13 wherein said first mounting means comprises a close spring latch pin to which said release lever is secured and rotated by said release lever to release said close spring means, and wherein said second mounting means comprises means mounting said close spring release platform on said close spring latch pin but for rotation independent of said close spring latch pin.

18. The electrical switching apparatus of claim 13 wherein said operating mechanism includes a cage formed by a pair of side plates and means fixing said side plates in rigid spaced relation, and wherein said first, second and third mounting means all are fully supported by said cage.

19. The electrical switching apparatus of claim 18 wherein said first mounting means comprises a close spring latch pin journalled in aligned apertures in said side plates.

20. The electrical switching apparatus of claim 19 wherein said second mounting means comprises means mounting said close spring release platform on said close spring latch pin but for rotation independent of said close spring latch pin.

* * * * *